US010376774B2

(12) United States Patent
Miller

(10) Patent No.: US 10,376,774 B2
(45) Date of Patent: Aug. 13, 2019

(54) CARD GAME AND HOLDER

(71) Applicant: Jane Miller, Ocala, FL (US)

(72) Inventor: Jane Miller, Ocala, FL (US)

( * ) Notice: Subject to any disclaimer, the term of this patent is extended or adjusted under 35 U.S.C. 154(b) by 79 days.

(21) Appl. No.: 15/469,336

(22) Filed: Mar. 24, 2017

(65) Prior Publication Data

US 2018/0272228 A1 Sep. 27, 2018

(51) Int. Cl.

| | |
|---|---|
| ***A63F 1/18*** | (2006.01) |
| ***A63F 1/00*** | (2006.01) |
| ***A63F 1/06*** | (2006.01) |
| ***A63F 11/00*** | (2006.01) |
| *A63F 9/12* | (2006.01) |
| *A63F 3/00* | (2006.01) |
| *A63F 9/32* | (2006.01) |

(52) U.S. Cl.

CPC ..... *A63F 1/00* (2013.01); *A63F 1/06* (2013.01); *A63F 1/18* (2013.01); *A63F 11/0051* (2013.01); *A63F 9/12* (2013.01); *A63F 9/1252* (2013.01); *A63F 9/32* (2013.01); *A63F 2003/00223* (2013.01); *A63F 2003/00946* (2013.01); *A63F 2009/1228* (2013.01); *A63F 2009/1236* (2013.01); *A63F 2011/0065* (2013.01)

(58) Field of Classification Search

CPC ..... A63F 1/18; A63F 2003/00946; A63F 9/0861; A63F 9/0865; A63F 9/1252; A63F 9/12; A63F 9/1204; A63F 9/32; A63F 2003/00848; A63F 2003/00839; A63F 2003/00223; A63F 2009/1228; A63F 2009/1236

USPC ..... 273/276, 148 R, 157 R, 156, 447

See application file for complete search history.

(56) References Cited

U.S. PATENT DOCUMENTS 1,709,660 A * 4/1929 De Bracht ..... A63F 9/1204 273/157 R
4,332,387 A * 6/1982 Mullen, III ..... A63F 9/12 273/156

(Continued)

FOREIGN PATENT DOCUMENTS

WO WO2013043760 A2 3/2013

OTHER PUBLICATIONS

Mr. Printables, Puzzles, Digital Number Puzzle, https://mrprintables.com/digital-number-puzzle.html.

*Primary Examiner* — Benjamin Layno
(74) *Attorney, Agent, or Firm* — Beusse, Wolter, Sanks & Maire PLLC; Robert L. Wolter

(57) ABSTRACT

The present invention relates to a method and apparatus for playing a multiplayer card game that includes a deck of cards and a holder. The card game utilizes a unique deck of cards and more than one option for gameplay. The variety of card combinations results in a novel and different experience every time the game is played.

The primary method for scoring points is by forming time values. Numbered cards are written in a digital type font from a combination of short, straight lines. Instead of the numbers themselves, these lines are counted and subsequently used for scoring. The winner is awarded elongated sticks for each set of points earned based on the time value formed. The elongated sticks are placed into open storage container until the containers are transformed into a solid shape with the final elongated stick protruding to indicate a player has won the game.

10 Claims, 14 Drawing Sheets

(56) References Cited

U.S. PATENT DOCUMENTS

| | | | | | |
|---|---|---|---|---|---|
| 4,804,187 | A * | 2/1989 | Cramer | A63F 9/12 | 273/157 R |
| 4,807,885 | A | 2/1989 | Chamblee | | |
| 5,683,252 | A * | 11/1997 | Tsao | A63F 9/0098 | 434/195 |
| 5,924,692 | A * | 7/1999 | Rosenberg | A63F 9/32 | 273/153 R |
| 6,257,575 | B1 * | 7/2001 | Ortega | A63F 3/00214 | 273/241 |
| 6,863,275 | B2 | 3/2005 | Chiu | | |
| 8,276,915 | B2 | 10/2012 | Berkowitz | | |
| 8,678,392 | B1 | 3/2014 | Alhazza | | |
| 9,308,436 | B1 | 4/2016 | Hays | | |
| 2004/0056421 | A1 | 3/2004 | Chiu | | |
| 2004/0084840 | A1 * | 5/2004 | Krigmont | A63F 9/32 | 273/272 |
| 2010/0148439 | A1 * | 6/2010 | Simonyan | A63F 9/0803 | 273/155 |
| 2010/0327526 | A1 * | 12/2010 | Auerbach | A63F 9/1204 | 273/157 R |
| 2013/0270770 | A1 | 10/2013 | Saddler | | |

* cited by examiner

300

Didgi-Sticks Score Sheet - Junior Version

| Player's Name | Round 1 | Round 2 | Round 3 | Round 4 | Round 5 | Totals |
|---|---|---|---|---|---|---|
| | | | | | | |
| | | | | | | |
| | | | | | | |
| | | | | | | |

Didgi-Sticks Score Sheet

| Player's Name | Round 1 | Round 2 | Round 3 | Round 4 | Round 5 | Totals |
|---|---|---|---|---|---|---|
| | | | | | | |
| | | | | | | |
| | | | | | | |
| | | | | | | |

Didgi-Sticks Score Sheet

| Player's Name | Round 1 | Round 2 | Round 3 | Round 4 | Round 5 | Totals |
|---|---|---|---|---|---|---|
| | | | | | | |
| | | | | | | |
| | | | | | | |
| | | | | | | |

FIG. 15

END VIEW

SIDE VIEW

TOP VIEW

CARD GAME AND HOLDER

CROSS-REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR

Not Applicable

BACKGROUND

Unless otherwise indicated herein, the materials described in this section are not prior art to the claims in this application and are not admitted to be prior art by inclusion in this section.

1. Field of the Invention

The present invention generally relates to a card game and container for holding winning sticks. More specifically, the present invention relates to a method and apparatus for playing a multiplayer card game that includes a deck of cards, a procedure for playing a game with the deck, and a container that transforms to indicate a winner.

2. Description of Related Art

A variety of games and strategies are commonly used to entertain guests and friends at social events. Among those methods, card games in particular have value as a means of facilitating comfortable interaction among people who may not know each other. Card games also allow players to bond over a relaxed activity that allows competitive and engaging fun. In addition, such interaction strengthens established friendships, deepening bonds, and provides variety to relationships that may otherwise stagnate. However, the traditional 52-card deck limits the variety of games that may be played. Thus, existing card games tend to become repetitive, boring, and uninteresting.

Accordingly, there is a need to make card games more entertaining and interesting. There is also a need for novelty and originality to keep card game enthusiasts satisfied. In addition, there is a need for games that can assist in connecting people together to enhance communication and enjoyment in any situation. The method and apparatus described in this patent application fulfill at least one of these needs or creates other utility.

BRIEF SUMMARY OF THE INVENTION

It is a principal object to solve at least one of the disadvantages with other attempted solutions or to create other utility by providing a method or apparatus that is interesting or original to keep card game enthusiasts satisfied. In addition, there is a need for games that can assist in connecting people together regardless of their previous relationships to each other. This is especially needed to enhance communication and enjoyment of strangers in a social setting. Furthermore, there is a need for a card game that is optimized for various age groups to allow for a broader potential player base.

The card game described in this patent application, which is often referred to as the Didgi-Sticks Card Game, fulfills at least one of these needs or creates other utility. The Didgi-Sticks Card Game utilizes a unique deck of cards and allows for multiple gameplay options. The variety of card combinations created by the Didgi-Sticks Card Game results in a new game experience every time the game is played.

In the Didgi-Sticks Card Game, numbered cards are written in a digital type font, where each number is formed from a combination of short straight lines. These short straight lines are counted and subsequently used for scoring, rather than the numbers that they form. This unique scoring provides a fresh take on traditional scoring methods. The digital number theme also serves to remind players of the primary method for scoring points, which is by making sequential three-card time values. The card game also includes a variety of special cards, including "Lose-A-Turn" cards, "Wild Card" cards, "10 Bonus Points" cards, and "Didgi Thief" cards. These special cards further facilitate social interaction by providing necessary agitation, disrupting opponent strategies, and keeping all players effectively engaged in the game until the end.

The special cards may be added and removed from the deck to allow for a more child-friendly Junior Version of the game or a more difficult Adult Version. The card game also allows adjustment of various card values in the deck to capture all the potential that the card game must offer. By varying the number and type of cards in the deck, the options for potential games become unlimited.

BRIEF DESCRIPTION OF THE DRAWINGS

The accompanying drawings, which are incorporated in and constitute a part of this specification, illustrate several aspects described below.

FIG. 15 is a front view of the optional scorecard of the present invention in which at least one of the embodiments of this invention is implemented.

DETAILED DESCRIPTION OF THE INVENTION

Figure 1:
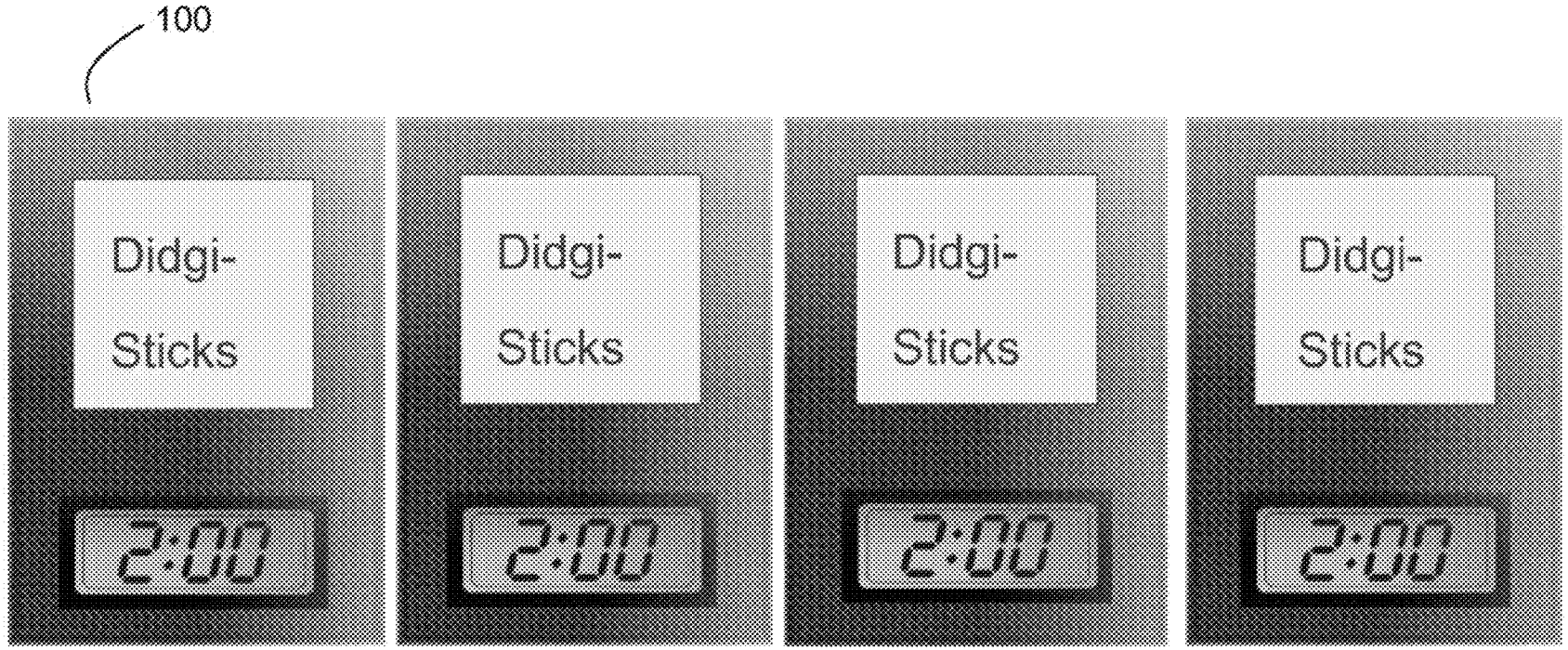
FIG. 1 is a back view of the Didgi-Sticks Card Game in which at least one of the embodiments of this invention is implemented.

It is to be understood that this invention is not limited to any particular embodiment described, which may vary. Also, it is to be understood that the terminology used herein is for describing particular embodiments only, and is not intended to be limiting, since the scope of this invention will be limited only by the appended claims.

In the following detailed description, numerous specific details are set forth in order to explain and provide a thorough understanding of the present invention. However, it is apparent that the present invention may be practiced without these specific details. Thus, all illustrations of the drawings are for describing versions of the present invention, and are not intended to limit the scope of the invention.

In the following section, the present invention is described fully by referencing the details in the enclosed drawings, which illustrate certain embodiments of the invention. The numbers shown in this specification refer to the corresponding numbers in the enclosed drawings. The terminology used is to describe the particular embodiment shown and is not intended to limit the scope of the invention. The invention may also be embodied in many other forms in addition to the embodiments shown. Thus, the embodiments shown should not be construed as limiting, but rather, to allow a thorough and complete description of the disclosure that conveys the scope of the invention to a person having ordinary skill in the art in the field of this invention. Therefore, for the terms used herein, the singular forms "the," "a," and "an" are intended to include the plural forms as well as the singular forms, unless the context clearly indicates otherwise. The term "and" includes any and all combinations of one or more of the associated listed items. As used herein, the terms "comprising" and "comprises" when used in this specification, identify specific steps, integers, operations, features, components, and elements, but do not preclude the presence or addition of one or more other steps, operations, features, components, and elements.

In addition, the features, components, and elements referenced may be exaggerated for clarity.

Unless otherwise defined, all scientific terms, technical terms, or other terms used herein have the same meaning as the term that is understood by one having ordinary skill in the art in the field of this invention. It is also understood that these terms, including their dictionary meaning, should be understood as having the meaning, which is consistent with their definitions in the related relevant art. In addition, the present disclosure is not to be interpreted in an idealized or overly formal sense unless expressly stated so herein. Constructions or functions that are well known in the art may not be fully described in detail for brevity.

In describing the invention, it is understood that several steps and methods may be disclosed. Each of these may have individual benefit. Also, each may be used in conjunction with at least one or more of the disclosed steps and methods. Therefore, this description will refrain from stating each and every possible combination of the individual steps and methods for the sake of brevity. Regardless, the specification and related claims should be understood with the combinations that are entirely within the scope of the claims and inventions.

The disclosure in this invention are examples of how it may be implemented and are not intended to limit the scope of the invention to the specific embodiments shown in the accompanying drawings or the description provided herein. All illustrations are for the purposes of describing selected versions of the present invention and are not intended to limit the scope of the present invention. The present invention will now be described by example in the following paragraphs by referencing the accompanying drawings, which represent embodiments and alternative embodiments.

During setup, the deck is prepared. To prepare the deck for the Junior Version, a player removes the plurality of Didgi-Thief cards 340 from the plurality of special cards. To prepare the deck for the Adult Version, a player removes the plurality of Bonus Cards 310 from the plurality of special cards. The players then shuffle the plurality of hour cards, the plurality of minute cards, and the remaining plurality of special cards together to form the deck. The players then place the deck onto the table.

Gameplay begins when the deck is set on the table. The gameplay phase comprises choosing a starting player, drawing cards, forming a time value, and completion. In an exemplary embodiment, playing order is determined by each player picking a card from the deck, and the highest card number determining the starting player. In alternative embodiments, the first player to pick cards from the deck may be determined by a variety of means, including coin tosses, consensus, and a variety of other means involving the deck of the present invention, and the exemplary embodiment is not meant to be limiting. When the first player is determined, the first player draws a plurality of cards from the deck. In at least one embodiment, there are four cards drawn from the deck during drawing. The first player attempts to combine the drawn cards to create a time value. A time value is a combination of one hour card and two minute cards. In an alternative embodiment, the time values must be real time values, so the minute cards must be played so that they range from 0:00 to 0:59.

If the first player has a valid time value, that player places the relevant three cards face up on the table, and places the fourth card face down on the table or surface, after showing the other players that it is not a Lose-a-Turn Card 320. The face down card forms the discard pile. If the first player cannot form a time value with the cards drawn, those cards are discarded, and the next player draws four cards. This process continues until a player successfully completes a time value and declares either the plurality of hour cards or the plurality of minute cards. To tally the score after each player plays a time value, the number of lines of the plurality of lines of the plurality of hour cards and the plurality of lines of the plurality of minute cards is counted and subsequently recorded in the appropriate slot on the optional scorecard 300. Play then continues clockwise around the table or surface. The next player draws a plurality of cards, preferably four cards, and attempts to form another time value. If the player cannot complete a time value, the player discards a plurality of cards from the player's hand, plays a special card, or places a minute card or hour card onto the table or surface face up for later use. If the player can form the next consecutive time value, the number of lines of the plurality of lines of the plurality of hour cards and the plurality of lines of the plurality of minute cards is counted and subsequently recorded in the appropriate slot on the optional scorecard 300.

In at least one embodiment, play continues until five rounds have passed, or when each player has had five turns to play cards. Then the completion step begins. The winner is the player with the highest number of points. The deck is then divided into the plurality of minute cards, the plurality of hour cards, and the plurality of special cards. The present invention is then ready for subsequent use.

Figure 2:
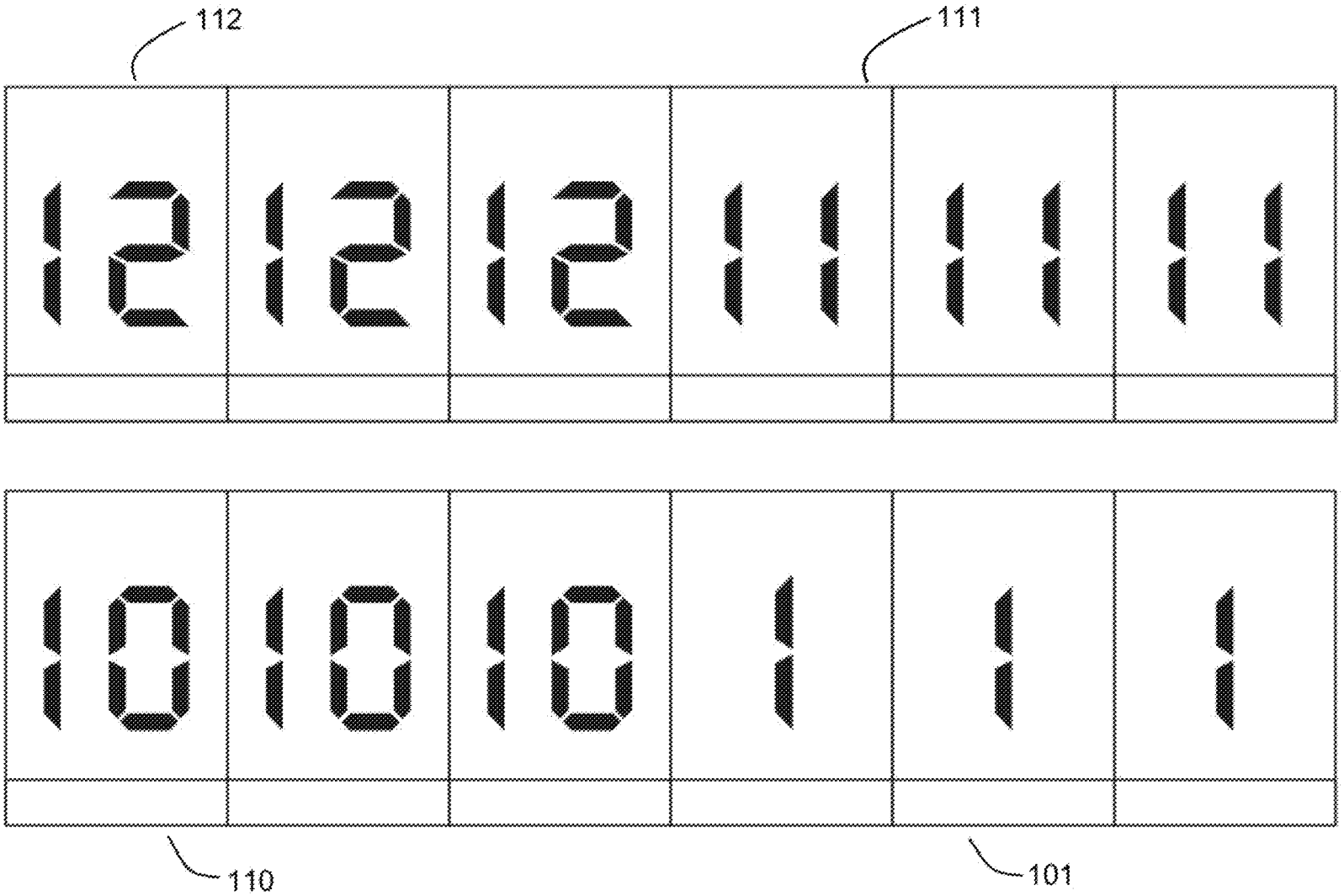
FIG. 2 is a front view of the hour cards showing 3 cards each for the hours of twelve o'clock, eleven o'clock, ten o'clock, and one o'clock in which at least one of the embodiments of this invention is implemented.
Figure 3:
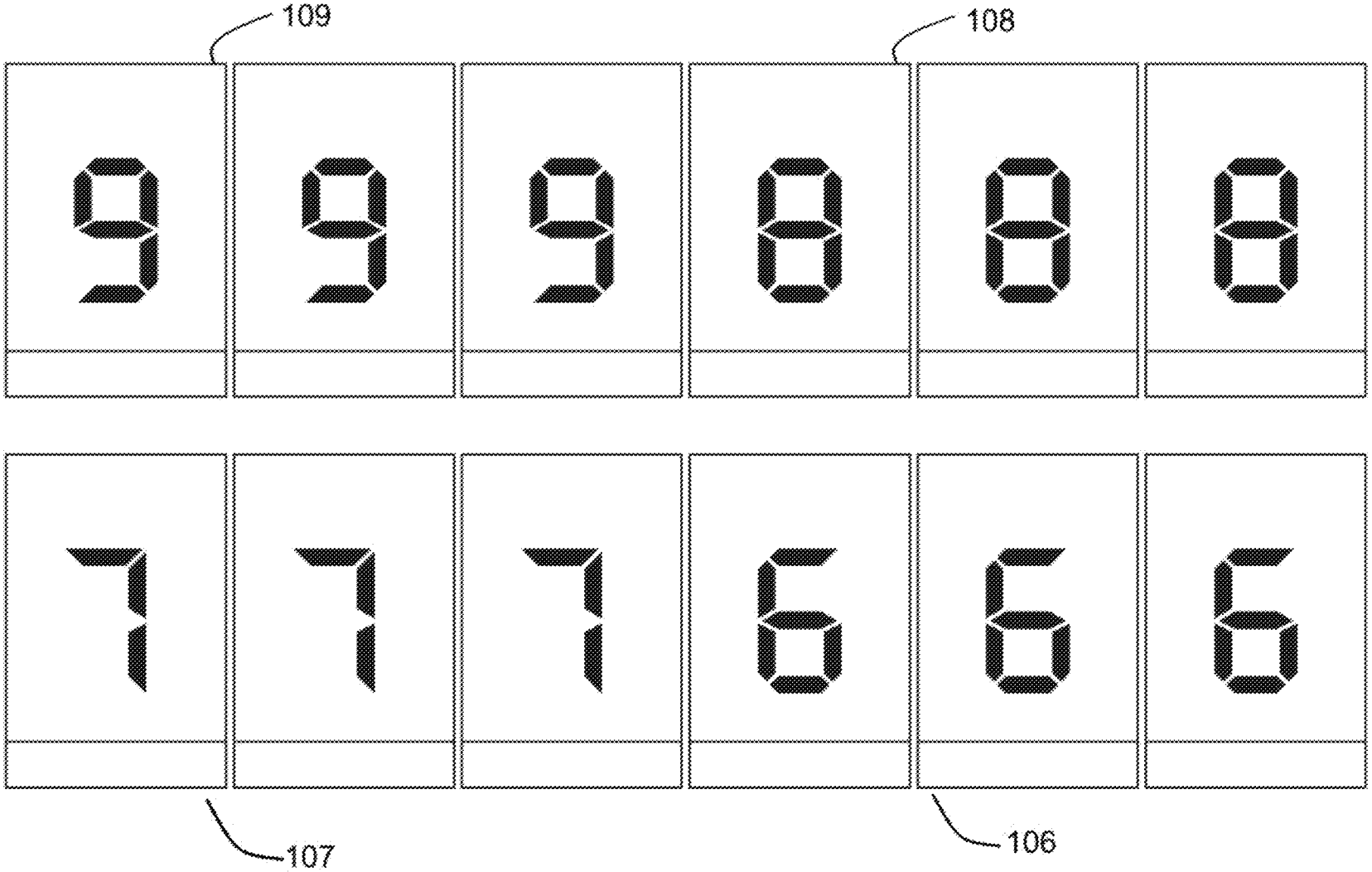
FIG. 3 is a front view of the hour cards showing 3 cards each for the hours of nine o'clock, eight o'clock, seven o'clock, and six o'clock in which at least one of the embodiments of this invention is implemented.
Figure 4:
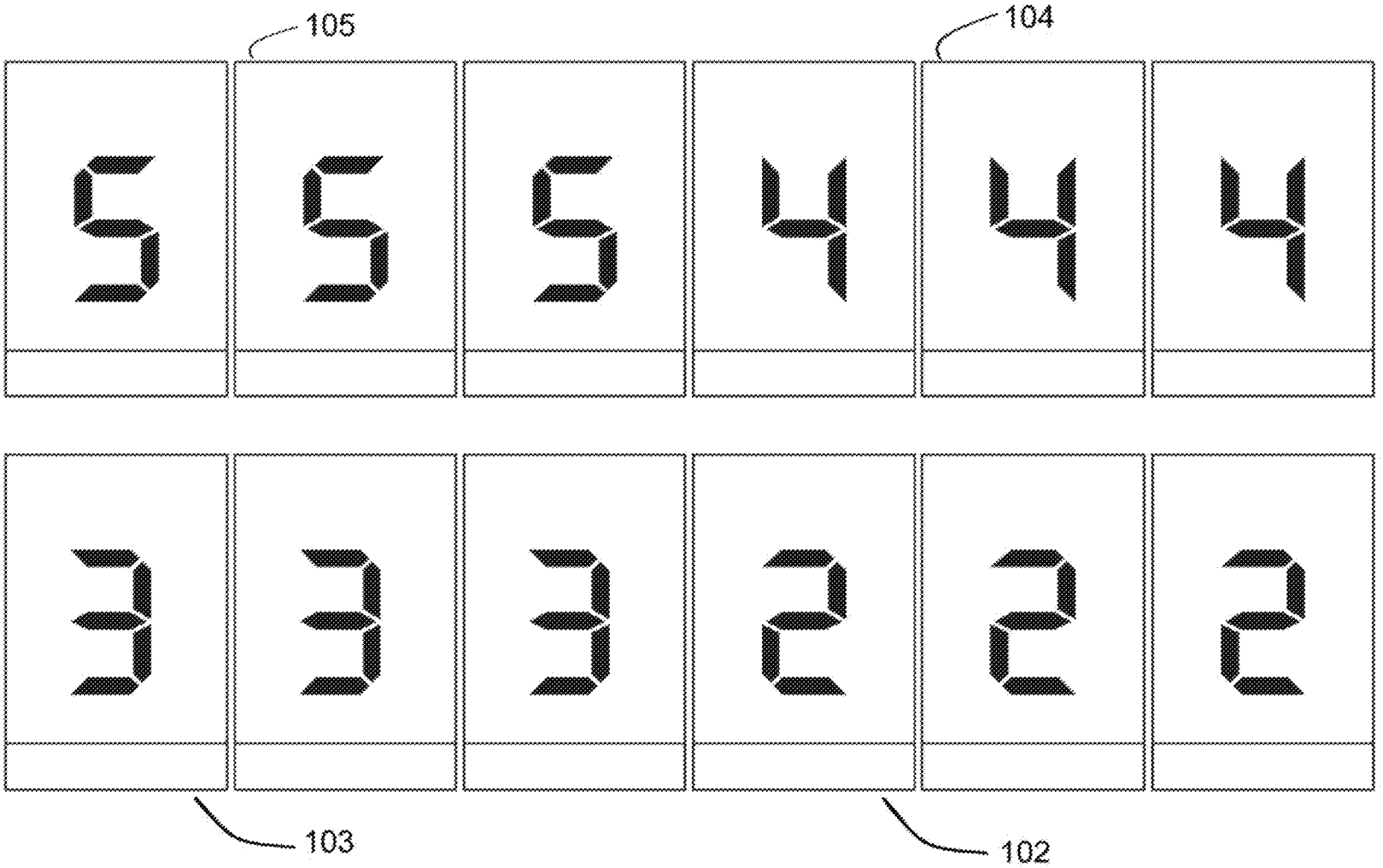
FIG. 4 is a front view of the hour cards showing 3 cards each for the hours of five o'clock, four o'clock, three o'clock, and two o'clock in which at least one of the embodiments of this invention is implemented.

The present invention is an apparatus and related method for a Didgi-Sticks Card Game that allows players to casually compete to earn points. The Didgi-Sticks Card Game apparatus comprises an optional scorecard 300 as seen in FIG. 15, a multitude of elongated sticks, referred to herein as "Didgi-Sticks" 400, which are like the one shown in FIG. 21, a container 410 for holding Didgi-Sticks 400 as seen in FIG. 20 and FIG. 22 through 26, and a deck of 116 cards. The deck comprises a plurality of hour cards as seen in FIG. 2 through 4, a plurality of minute cards as seen in FIG. 5 through 14, and a plurality of special cards as seen in FIG. 16 through 19.

One embodiment of the invention allows children to play a Junior Version of the game. For the Junior Version, the object is for each player to collect the most Didgi-Sticks 400 in a predetermined number of rounds of play, such as 5 rounds of play.

Another version of the invention is to allow adults play an Adult Version of the game. For the Adult Version, in at least one embodiment, the object is for each player is also to collect the most Didgi-Sticks 400 in a predetermined number of rounds of play, such as 3 to 5 rounds of play. The game may be played with two or more players, who are ages 6 to adult. A deck for the game has 116 cards, which comprises 36 hour cards, 64 minute cards, and 16 specialty cards.

FIG. 1 shows a back view of the Didgi-Sticks Card Game 100. The back view 100 of each card is identical, so that it is not possible for any players to know whether the card is an hour card, minute card, or a specialty card when viewed from the back side. For the hour cards, which may be blue in color, there are 3 cards for each of the numbers 1 through 12, which represent the hours of a clock.

FIG. 2 is a front view of hour cards "12" for twelve o'clock 112, "11" for eleven o'clock 111, "10" for ten o'clock 110, and "1" for one o'clock 101. The number "12" for twelve o'clock 112 is formed by arranging the segments of the digital numbers, by placing two segments in a vertical orientation on top of each other to form the number "1". The number "2" is formed by the combination of two segments in a vertical orientation and three segments in a horizontal orientation for a total of five segments. Thus, the number "12" has a total of seven segments, which is the sum of the two segments that form the number "1" and the five segments that form the number "2." Since the number "12" has a total of seven segments, it is worth seven points.

The number "11" is formed from two number "1s" placed next to each other. Since each "1" contains two segments, the number "11" contains four segments, and is valued at 4 points.

The number "10" is formed from a number "1" that contains two segments, and the number "0", which is formed by the combination of four segments in a vertical orientation and two segments in a horizontal orientation for a total of six segments. Thus, the number "10" has a total of eight segments, which is the sum of the two segments that form the number "1" and the six segments that form the number "0." Therefore, the number "10" is worth eight points.

FIG. 3 is a front view of hour cards "9" for nine o'clock 109, "8" for eight o'clock 108, "7" for seven o'clock 107, and "6" for six o'clock 106. As shown in FIG. 3, the number "9" is formed by the combination of three segments in a vertical orientation and three segments in a horizontal orientation for a total of six segments. Thus, the number "9" is worth six segments or six points.

Also, as shown in FIG. 3, the number "8" is formed by the combination of four segments in a vertical orientation and three segments in a horizontal orientation for a total of seven segments. Thus, the number "8" is worth seven segments or seven points.

In addition, as shown in FIG. 3, the number "7" is formed by the combination of two segments in a vertical orientation and one segment in a horizontal orientation for a total of three segments. Thus, the number "7" is worth three segments or three points.

Furthermore, as shown in FIG. 3, the number "6" is formed by the combination of three segments in a vertical orientation and three segments in a horizontal orientation for a total of six segments. Thus, the number "6" is worth six segments or six points.

FIG. 4 is a front view of hour cards "5" for five o'clock 105, "4" for four o'clock 104, "3" for three o'clock 103, and "2" for two o'clock 102. As shown in FIG. 4, the number "5" is formed by the combination of two segments in a vertical orientation and three segments in a horizontal orientation for a total of five segments. Thus, the number "5" is worth five segments or five points.

Also, as shown in FIG. 4, the number "4" is formed by the combination of three segments in a vertical orientation and one segment in a horizontal orientation for a total of four segments. Thus, the number "4" is worth four segments or four points.

In addition, as shown in FIG. 4, the number "3" is formed by the combination of two segments in a vertical orientation and three segments in a horizontal orientation for a total of five segments. Thus, the number "3" is worth five segments or five points.

Furthermore, as shown in FIG. 4, the number "2" is formed by the combination of two segments in a vertical orientation and three segments in a horizontal orientation for a total of five segments. Thus, the number "2" is worth five segments or five points.

In summary, the hour cards, as shown in FIG. 2 through 4, are assigned the following point values: 2 points for one o'clock, 5 points for two o'clock 102, 5 points for three o'clock 103, 4 points for four o'clock 104, 5 points for five o'clock 105, 6 points for six o'clock 106, 3 points for seven o'clock 107, seven points for eight o'clock 108, 6 points for nine o'clock 109, 8 points for ten o'clock 110, 4 points for eleven o'clock 111, and seven points for twelve o'clock 112.

Thus, to maximize a player's point value, he would desire to receive and use the following hour cards: ideally ten o'clock 110 (8 points), then either eight o'clock 108 or twelve o'clock 112 (7 points), then either six o'clock 106 or nine o'clock 109 (6 points), then either two o'clock 102, three o'clock 103, or five o'clock 105 (5 points), then either four o'clock 104 or eleven o'clock 111 (4 points), then seven o'clock 107 (3 points), and then one o'clock 101 (2 points).

Figure 5:
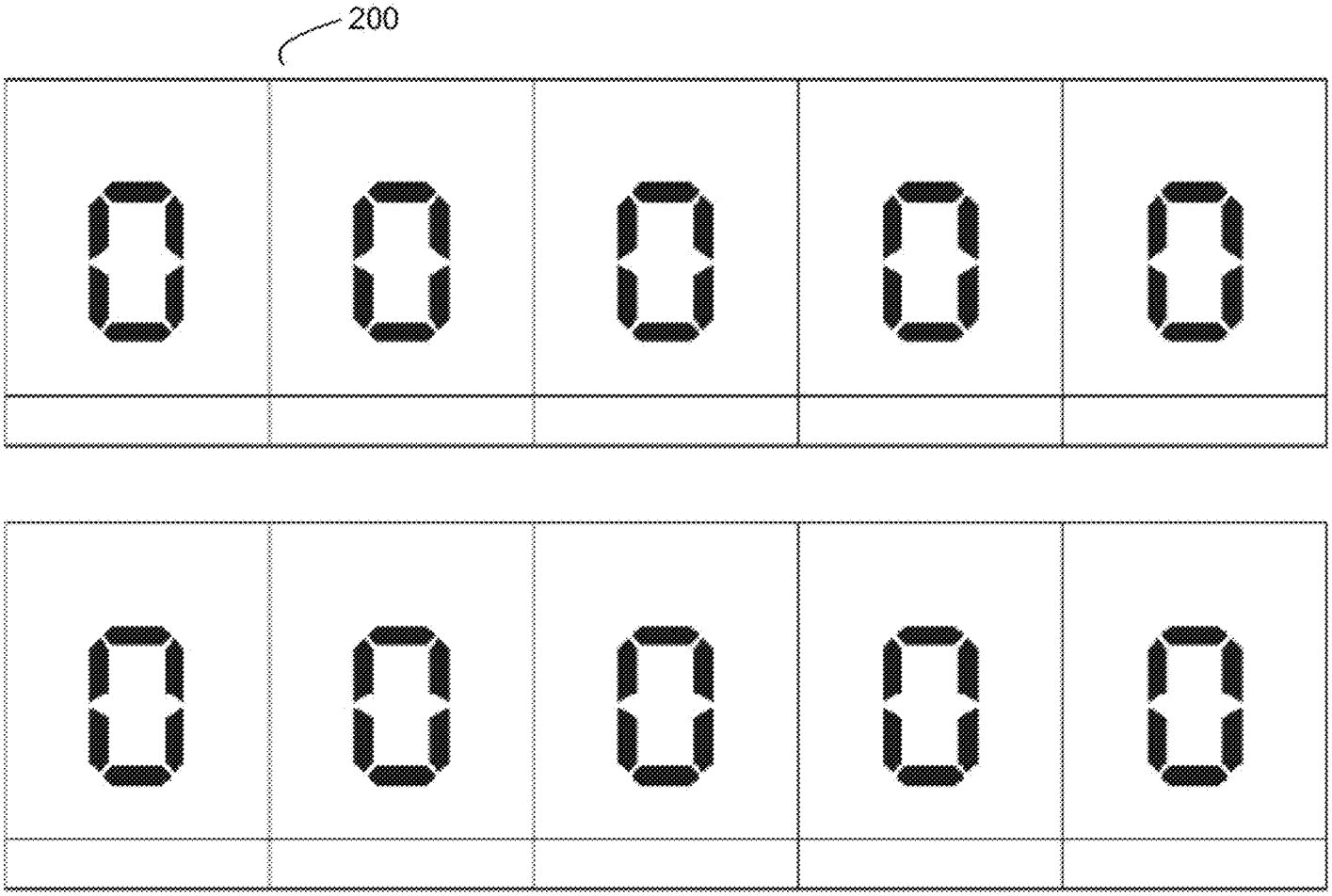
FIG. 5 is a front view of the minute cards showing 10 cards each for the zero (0) minute cards of the present invention in which at least one of the embodiments of this invention is implemented.
Figure 6:
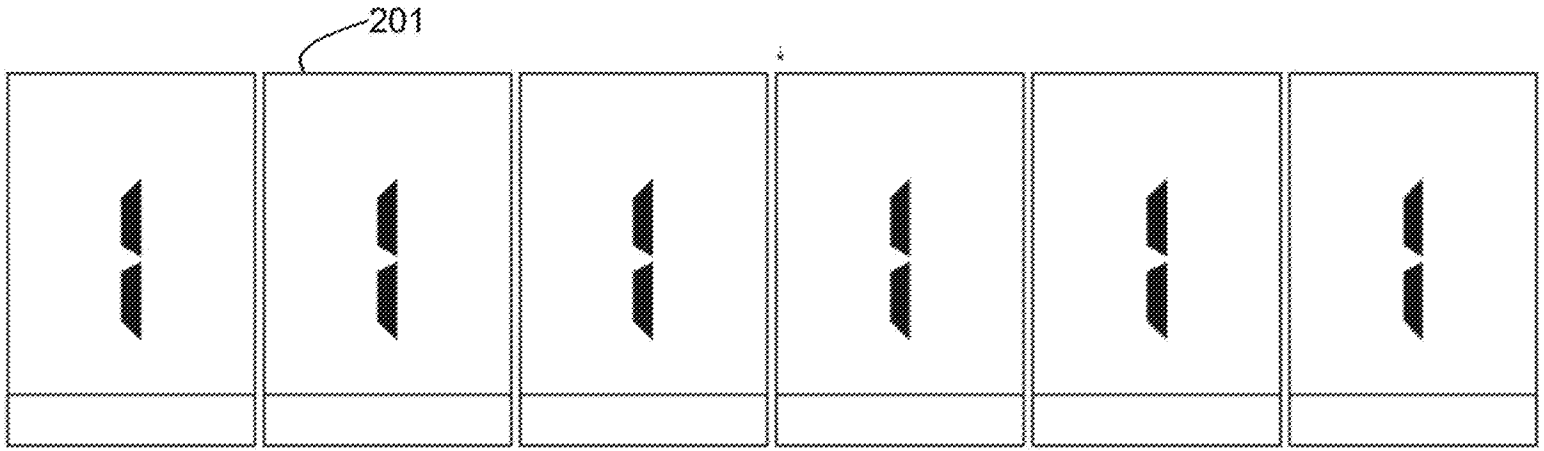
FIG. 6 is a front view of the minute cards showing 6 cards each for the one (1) minute cards of the present invention in which at least one of the embodiments of this invention is implemented.
Figure 7:
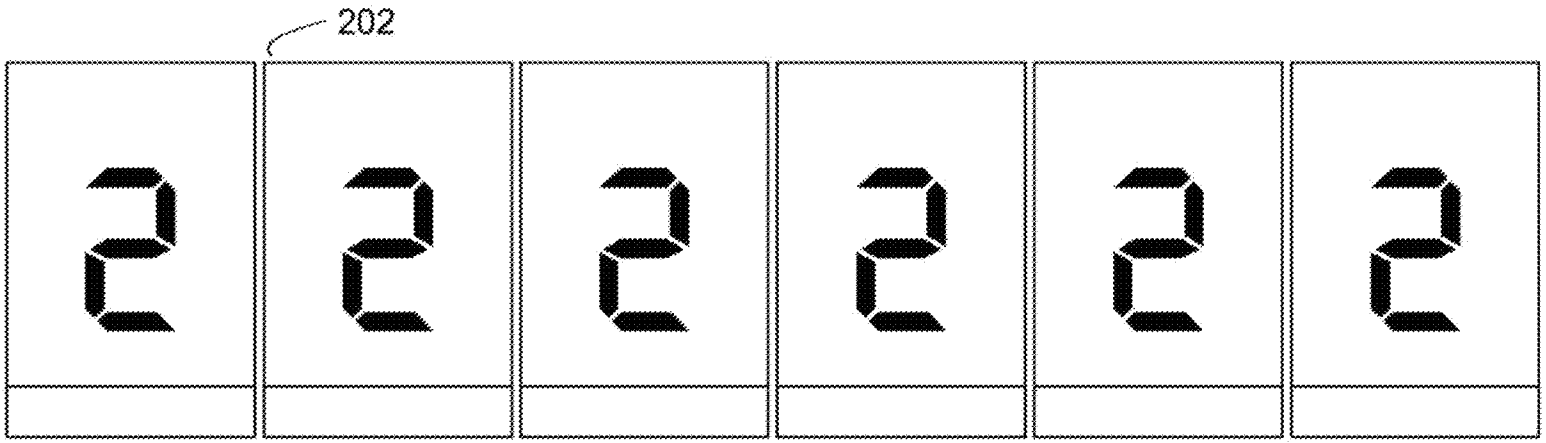
FIG. 7 is a front view of the minute cards showing 6 cards each for the two (2) minute cards of the present invention in which at least one of the embodiments of this invention is implemented.
Figure 8:
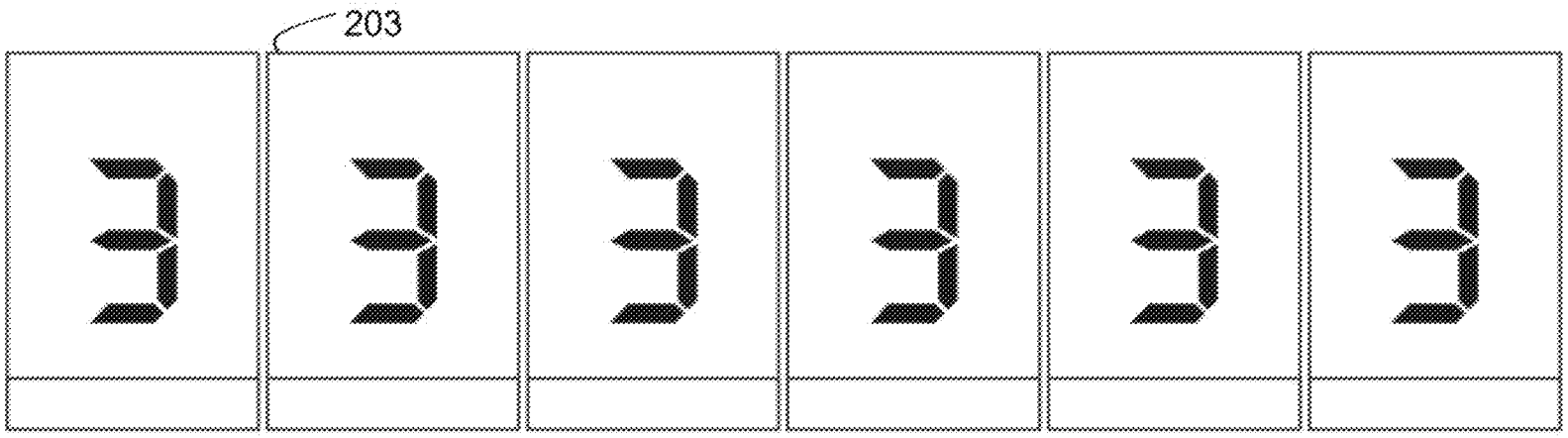
FIG. 8 is a front view of the minute cards showing 6 cards each for the three (3) minute cards of the present invention in which at least one of the embodiments of this invention is implemented.
Figure 9:
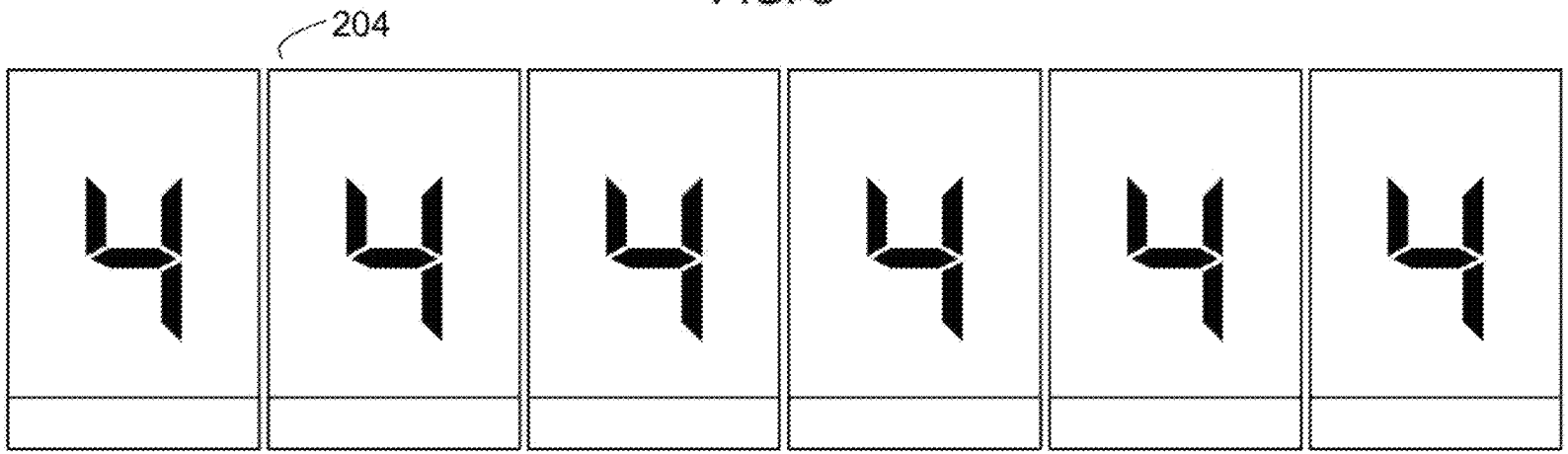
FIG. 9 is a front view of the minute cards showing 6 cards each for the four (4) minute cards of the present invention in which at least one of the embodiments of this invention is implemented.
Figure 10:
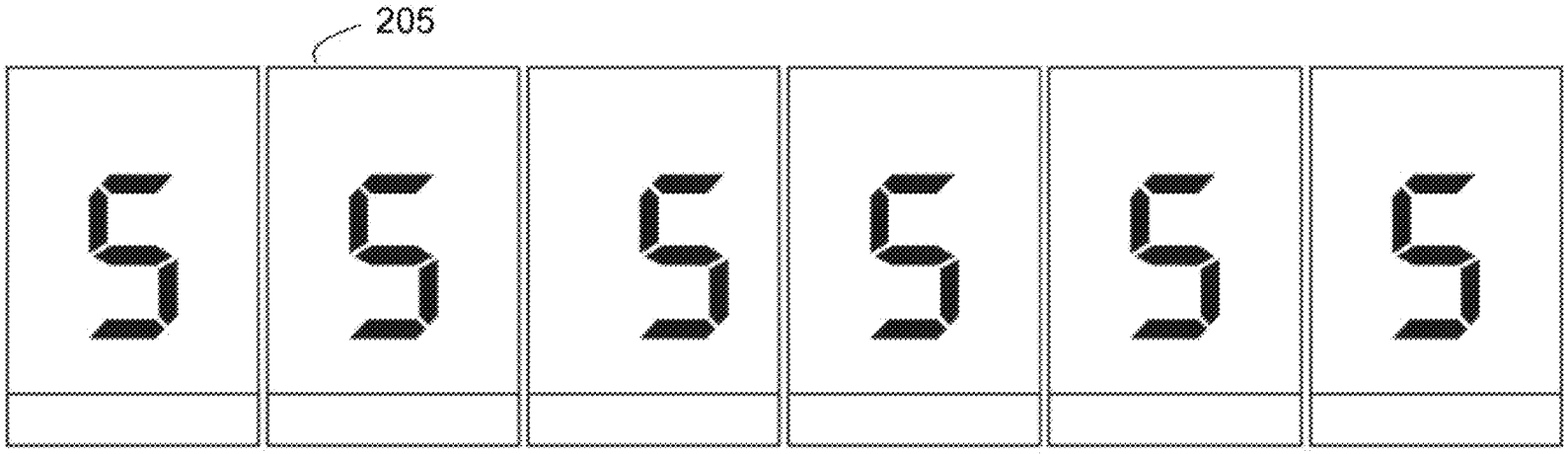
FIG. 10 is a front view of the minute cards showing 6 cards each for the five (5) minute cards of the present invention in which at least one of the embodiments of this invention is implemented.
Figure 11:
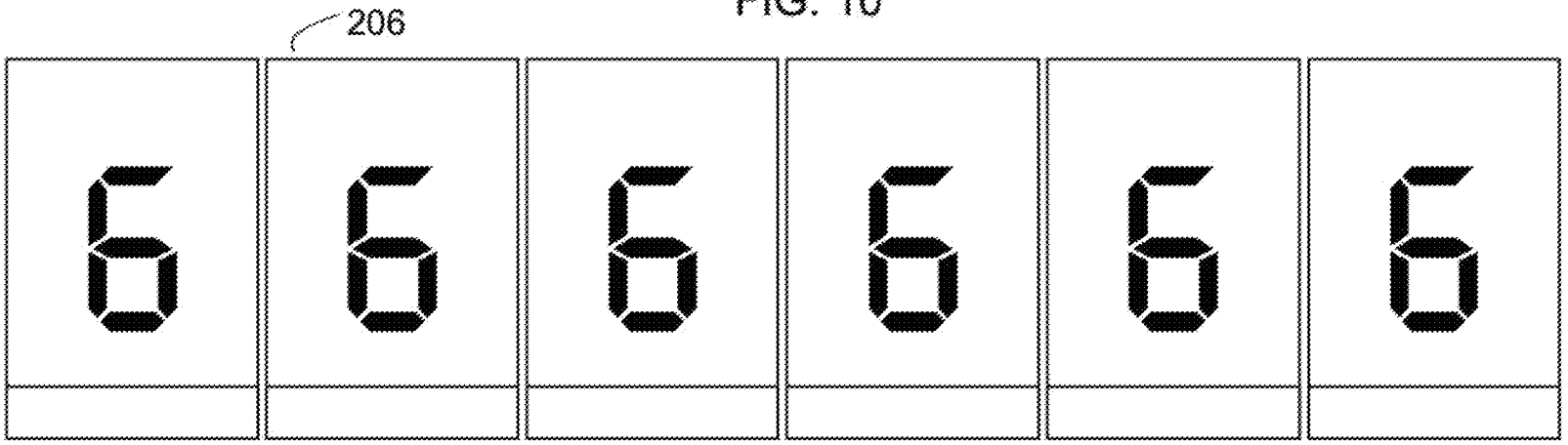
FIG. 11 is a front view of the minute cards showing 6 cards each for the six (6) minute cards of the present invention in which at least one of the embodiments of this invention is implemented.
Figure 12:
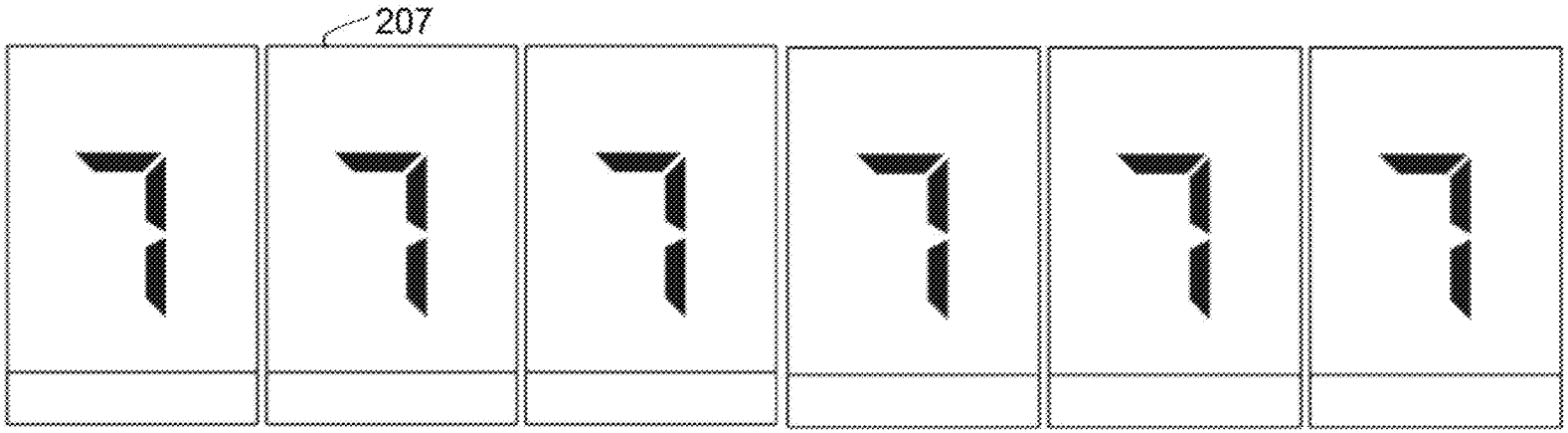
FIG. 12 is a front view of the minute cards showing 6 cards each for the seven (7) minute cards of the present invention in which at least one of the embodiments of this invention is implemented.
Figure 13:
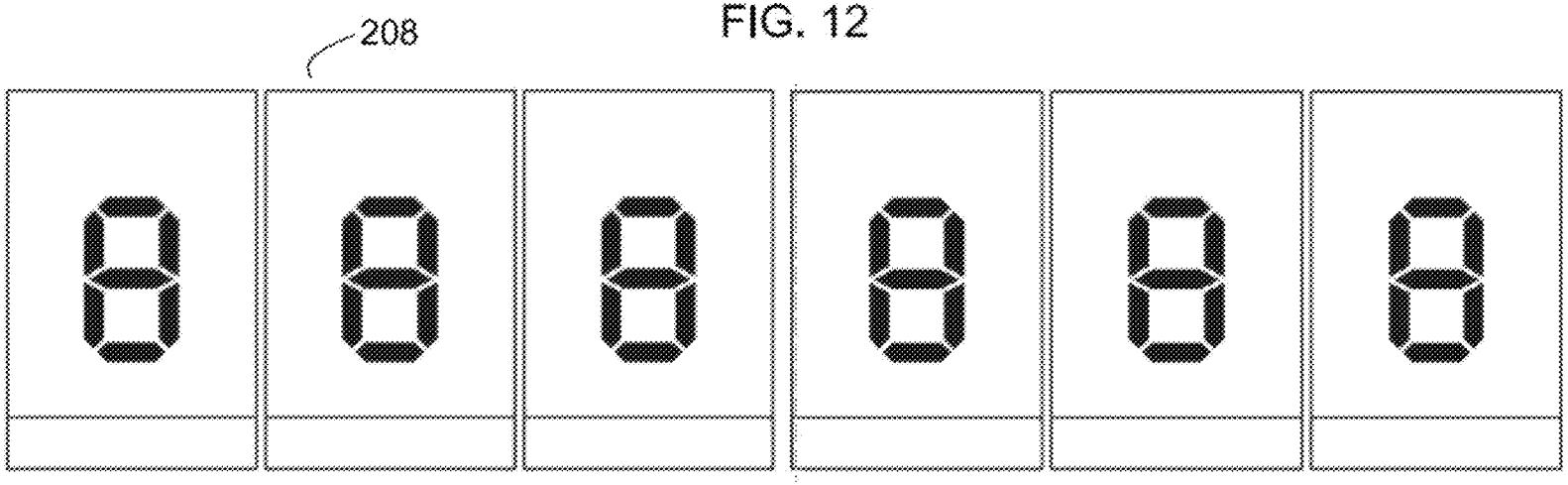
FIG. 13 is a front view of the minute cards showing 6 cards each for the eight (8) minute cards of the present invention in which at least one of the embodiments of this invention is implemented.
Figure 14:
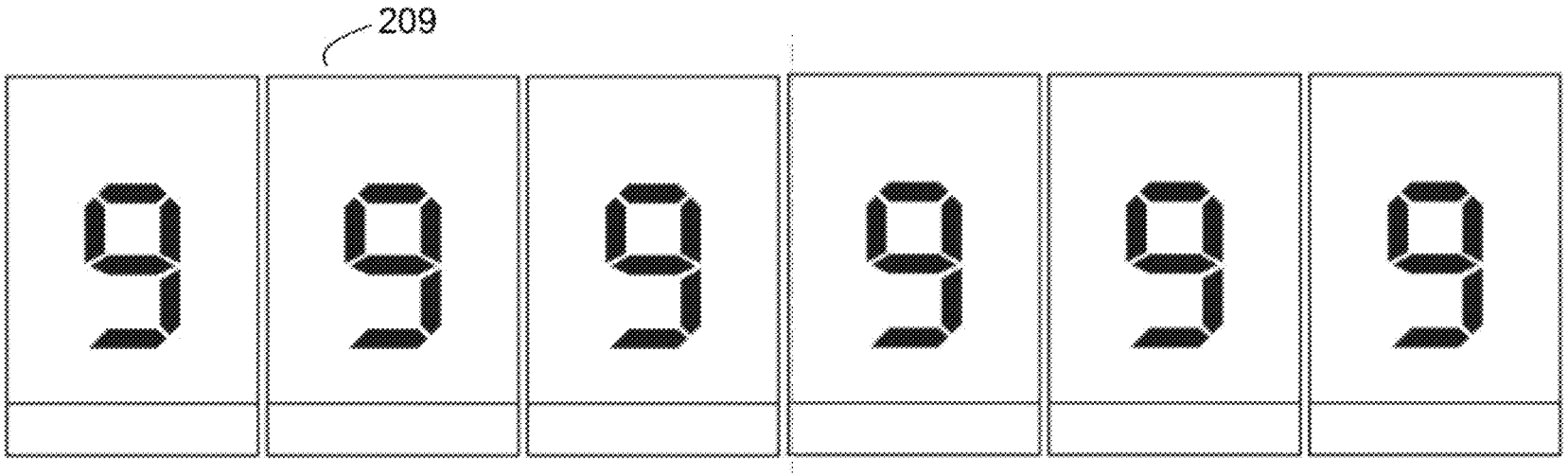
FIG. 14 is a front view of the minute cards showing 6 cards each for the nine (9) minute cards of the present invention in which at least one of the embodiments of this invention is implemented.

FIG. 5 is a front view of the minute cards showing 10 cards each for the zero (0) minute cards 200. FIG. 6 is a front view of the minute cards showing 6 cards each for the one (1) minute cards 201. FIG. 7 is a front view of the minute cards showing 6 cards each for the two (2) minute cards 202. FIG. 8 is a front view of the minute cards showing 6 cards each for the three (3) minute cards 203. FIG. 9 is a front view of the minute cards showing 6 cards each for the four (4) minute cards 204. FIG. 10 is a front view of the minute cards showing 6 cards each for the five (5) minute cards 205. FIG. 11 is a front view of the minute cards showing 6 cards each for the six (6) minute cards 206. FIG. 12 is a front view of the minute cards showing 6 cards each for the seven (7) minute cards 207. FIG. 13 is a front view of the minute cards showing 6 cards each for the eight (8) minute cards 208. FIG. 14 is a front view of the minute cards showing 6 cards each for the nine (9) minute cards 209.

For the minute cards, as shown in FIG. 5 through 14, which may be green in color, there are 10 cards of zero minutes, 6 cards for each of the minutes numbered 1 through 9, which represent the minutes of each number. Like the hour cards, the minute cards receive one point for each segment. For example, the minute cards are assigned the following point values: 6 points for zero minutes 200, 2 points for one minute 201, 5 points for two minutes 202, 5 points for three minutes 203, 4 points for four minutes 204, 5 points for five minutes 205, 6 points for six minutes 206, 3 points for seven minutes 207, 7 points for eight minutes 208, and 6 points for nine minutes 209.

Figure 16:
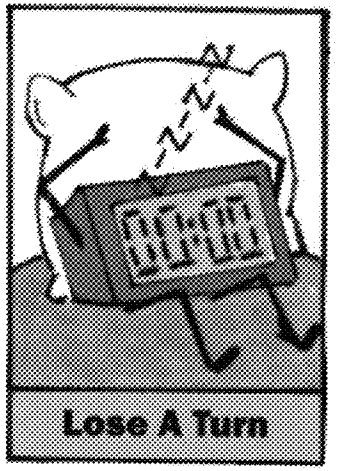
FIG. 16 is a front view of the "Lose-A-Turn" special card of the present invention in which at least one of the embodiments of this invention is implemented.
Figure 17:
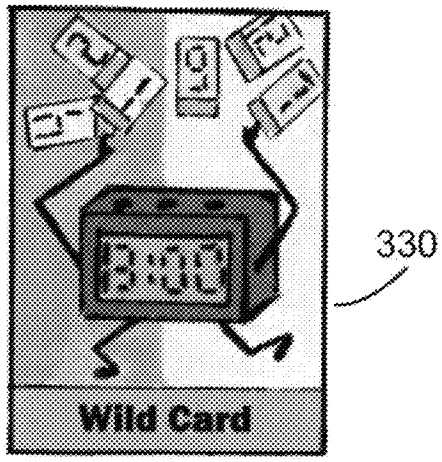
FIG. 17 is a front view of the "Wild Card" special card of the present invention in which at least one of the embodiments of this invention is implemented.
Figure 18:
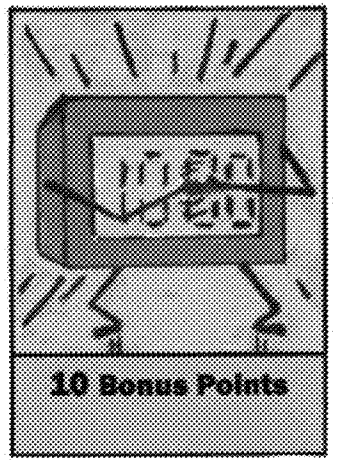
FIG. 18 is a front view of the "10 Bonus Points" special card of the present invention in which at least one of the embodiments of this invention is implemented.
Figure 19:
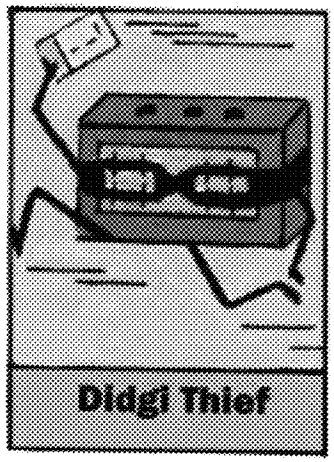
FIG. 19 is a front view of the "Didgi Thief" special card of the present invention in which at least one of the embodiments of this invention is implemented.

The remaining 16 cards are referred to as the specialty cards, which may be yellow in color. The specialty cards are shown in FIG. 16 through 19. FIG. 16 is a front view of the "Lose-A-Turn" 320 special card. FIG. 17 is a front view of the "Wild Card" 330 special card. FIG. 18 is a front view of the "10 Bonus Points" 310 special card. FIG. 19 is a front view of the "Didgi Thief" 340 special card. There are four "Lose-a-Turn 320" cards, four "Bonus" 310 cards, four "Wild" 330 cards, and four "Didgi-Thief" 340 cards.

The Lose-a-Turn Card 320 means a time value cannot be formed even if the other three cards held by that player otherwise form a time value. A Wild Card 330 may be used as either any hour card or any minute card to form a time value. The Bonus Card 310, which may be used for the Junior Version, adds 10 points to the player's score, if a time value can be formed with the remaining three cards drawn. The Didgi-Thief card enables a player to "steal" a card from another player, including a Wild Card 330, to add to her time value. In at least one embodiment of the game, the "stolen" Wild Card 330 is placed in its new position and may remain in that position until it is "stolen" again by another player.

Figure 21:
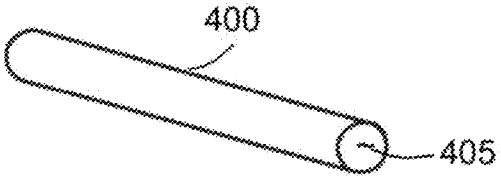
FIG. 21 is a perspective view of one of the Didgi-Sticks that may be placed in the elongated hexagonal container in which at least one of the embodiments of this invention is implemented.
Figure 20:
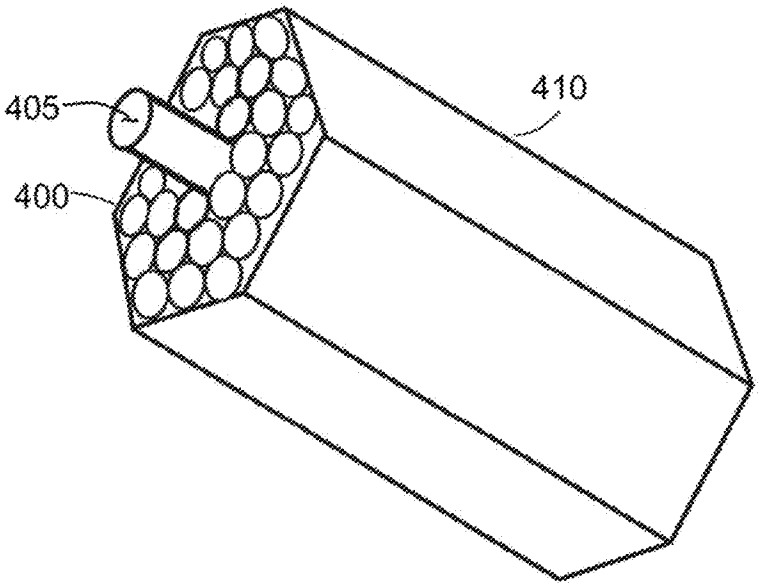
FIG. 20 is a perspective top view of the elongated hexagonal container that is used to contain a multitude of elongated sticks, referred to herein as "Didgi-Sticks" that may be won during one or more rounds of play that also indicates that a player has won the game by having the last Didgi-Stick to be placed in the container protrude from the center of the container in which at least one of the embodiments of this invention is implemented.
Figures 24, 25, 26:
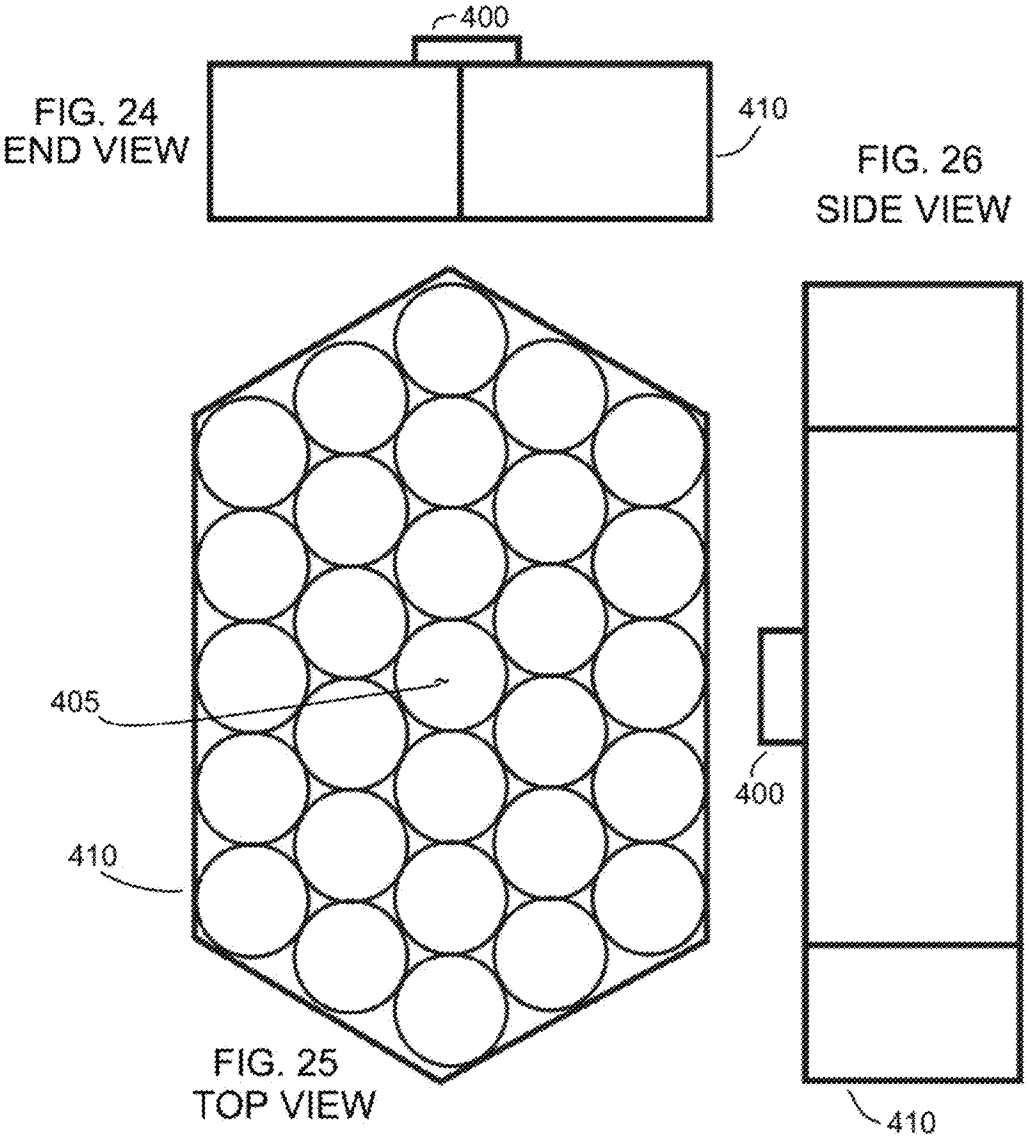
FIG. 24 is an end view of the elongated hexagonal container that is used to contain Didgi-Sticks that allows the last Didgi-Stick to protrude from the top of the container in which at least one of the embodiments of this invention is implemented.
FIG. 25 is a top view of the elongated hexagonal container that is used to contain Didgi-Sticks that allows the last Didgi-Stick to protrude from the top of the container in which at least one of the embodiments of this invention is implemented.
FIG. 26 is a side view of the elongated hexagonal container that is used to contain Didgi-Sticks that allows the last Didgi-Stick to protrude from the top of the container in which at least one of the embodiments of this invention is implemented.

As shown in FIGS. 20 and 21, the game includes four elongated hexagonal containers 410 to hold Didgi-Sticks 400, so that up to four persons or teams may play. The game also includes 116 Didgi-Sticks 400. For example, each container 410 may contain up to 29 Didgi-Sticks 400. As shown in FIG. 25, the game may include a total of 116 Didgi-Sticks 400, so that each open storage container 410 may be filled with Didgi-Sticks 400. The open storage containers 410 also provide for a method to store Didgi-Sticks 400 when the game is not being played.

In at least one embodiment, as shown in FIG. 21, one end of the Didgi-Sticks 400 may have an end 405 that is selected from the group consisting of wedge-shape, pyramid-shape, conical-shape, and semispherical shape, wherein the end 405 of the Didgi-Sticks 400 prevent them from resting on the top of an obstruction 420, such as an inverted cone, until the last elongated stick is placed in the open storage container 410. The obstruction 420, which may be an inverted cone, may be in the center of the open storage container 410, so that it may both divert all but the last Didgi-Stick 400 placed in the open storage container into the space surrounding the obstruction 420, and support the final Didgi-Stick 400 placed in the open storage container 410 at a higher elevation than all the other Didgi-Sticks 400.

The Didgi-Sticks 400 may have a length of approximately 1-inch to 12-inches, and a diameter of ¼-inch to 2-inches. The Didgi-Sticks 400 may either be solid or hollow, and may be constructed of a material that is made of plastic, metal, glass, wood, or another suitable material. The container 410 may have a length of approximately 2-inch to 15-inches, a width of ½-inch to 12-inches, and a height of 1.25-inch to 12-inches, which may depend on the size and the number of Didgi-Sticks 400 required to fill the container 410. The container 410 may be constructed of a material that is made of plastic, metal, glass, wood, or another suitable material.

To play the Junior Version Game, in at least one embodiment, the Didgi-Thief cards 340 are removed from the deck, while the Bonus Card 310 remain in the deck. A scorekeeper is then chosen, who will enter the players' names on the optional scorecard 300. The cards are then shuffled and placed face down in the center of the table. In at least one embodiment, the Junior Version of the game may be played for a predetermined number of rounds, such as three to five rounds of play. At the end of the final round, the winner is determined to be the player with the most Didgi-Sticks 400.

In at least one embodiment, in either the Junior Version or the Adult Version of the game, the number of rounds may be unlimited, wherein the winner is determined by the first person who completely fills his or her container 410 with Didgi-Sticks 400. When the container 410 is filled with Didgi-Sticks 400, it transforms into a shape that resembles the center horizontal segment of the numbers "2," "3," "4," or "5," "6," "8," or "9," as shown in FIG. 3 and FIG. 4. To further signify the winner, the last Didgi-Stick 400 remains in an elevated position in the center of the container 410, which gives a visual cue to all players as to the winner without the need to count any player's Didgi-Sticks 400.

Figure 23:
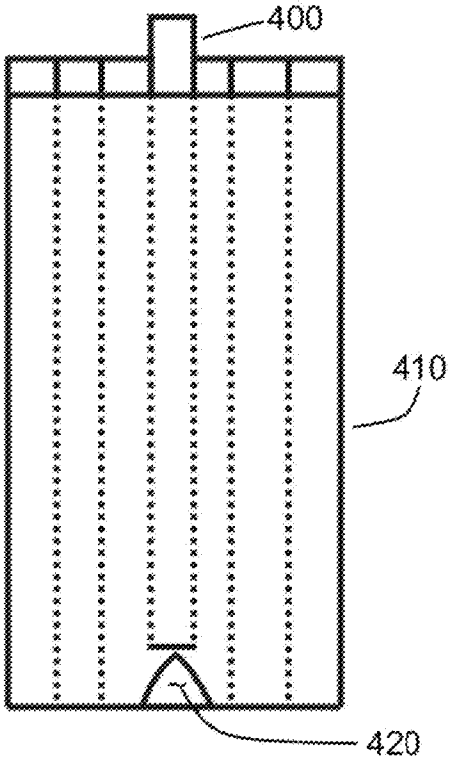
FIG. 23 is a side view of the elongated hexagonal container that is used to contain Didgi-Sticks that illustrates an inverted cone in the bottom center of the container that allows the last Didgi-Stick to be placed in the container to protrude from the top of the container in which at least one of the embodiments of this invention is implemented.
Figure 22:
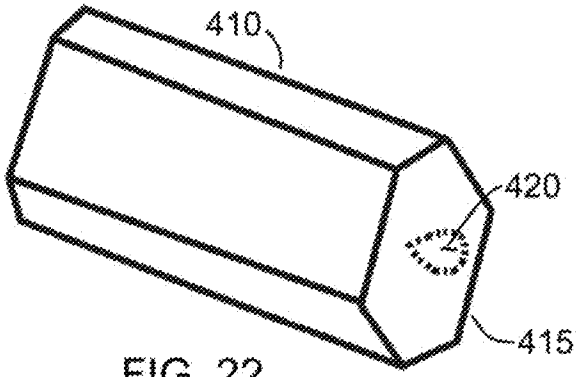
FIG. 22 is a perspective bottom view of the elongated hexagonal container that is used to contain Didgi-Sticks that illustrates an inverted cone in the bottom center of the container that allows the last Didgi-Stick to be placed in the container to protrude from the container in which at least one of the embodiments of this invention is implemented.

For example, FIG. 24 through 26 show the end, top, and side views, respectively, of one possible container 410 for holding Didgi-Sticks 400. Only, the last Didgi-Stick 400 placed in the center of the open storage container 410 is in an elevated position, because it is placed on top of an obstruction 420, which may be an inverted vertical cone or other shape. This elevated position is achieved by an inverted vertical cone 420 that is placed in the bottom 415 center of the container 410 as shown in FIGS. 22 and 23.

In at least one embodiment of the game, all players draw four cards from the deck. Each player reviews his cards to see if she has a combination of at least one hour card and at least two minute cards or a Wild Card 330 to use in place of an hour or a minute card. If so, the player places one hour card and two minute cards face up, on the table as it would appear on a digital clock. Each player also shows his fourth card that is not being played face up away from the other cards. This allows the other players to see if he has drawn a Lose-a-Turn 320 card. If he has drawn a Lose-a-Turn 320 card, his turn ends immediately. For each player who has not drawn a Lose-a-Turn 320 card, he counts the number of segments that are used to form the digital numbers on each card used in the time value that he has selected. In at least one embodiment of the game, the scorekeeper records each player's total on the scorecard 300. In at least one other embodiment of the game, a player may receive one Didgi-Stick 400 per a predetermined set of points, such as one Didgi-Stick 400 for each 5 points scored, where the player's total score is the sum of all the segments in the time value he has formed. The player may then place each Didgi-Stick 400 won in the open storage container 410.

If the cards drawn cannot form a digital time value, and do not include a Bonus Card 310, no score can be made, and that player's turn is over. Each player then turns his unused cards face down. When all player's turns are completed, the unused cards are placed in a discard pile and are not used again until all cards are drawn from the deck. In at least one embodiment of the Junior Version of the game, at the end of five rounds, after each player has taken five turns, the player with the most Didgi-Sticks 400 is declared the winner. In at least one embodiment of the Adult Version of the game, the player who first fills his open storage container 410 with Didgi-Sticks 400 is declared the winner.

For example, suppose in a round, Player A receives 10 as an hour card 110; and 2, 4, and 7 as minute cards, 202, 204, and 207, respectively. Thus, Player A may form the following time values: 10:24 and 10:27. As shown in FIG. 2, the "10" 110 is formed with 8 segments, so it is worth 8 points. As shown in FIG. 4, the "2" 202 is formed with 5 segments, so it is worth 5 points. Also, as shown in FIG. 4, the "4" 204 is formed with 4 segments, so it is worth 4 points. Thus, the time value 10:24 contains 17 segments, so it is worth 17 points. As shown in FIG. 3, the "7" 207 is formed with 3 segments, so it is worth 3 points. Thus, the time value 10:27 contains 16 segments, so it is only worth 16 points. However, in this embodiment, each player only receives one Didgi-Stick 400 for each 5 points scored. Thus, regardless of whether Player A forms 10:24 for 17 points or 10:27 for 16 points, he will still receive 3 Didgi-Sticks 400 for having at least 15 points, but less than 20 points. In other embodiments of the games, a different point value may be determined for each Didgi-Stick 400 at either the beginning of the game or a round.

In this same example, suppose Player B receives 10 as an hour card 110; and 2, 5, and 6 as minute cards, 202, 205, and 206, respectively. Thus, Player B may form the following time values: 10:25, 10:26, 10:52, and 10:56. As discussed above, the "10" 110 is worth 8 points, and the "2" 202 is worth 5 points. The "5" 205 is formed with 5 segments, so it is worth 5 points. The "6" 206 is formed with 6 segments, so it is worth 6 points. Thus, Player B may choose time value 10:25, which is worth 18 points (8+5+5); 10:26, which is worth 19 points (8+5+6); 10:52, which is worth 18 points (8+5+5); or 10:56, which is worth 19 points (8+5+6). Since each player receives a Didgi-Stick 400 for each 5 points scored, and Player B can form time values worth either 18 or 19 points, he would also receive 3 segments, regardless of whether he formed 10:25, 10:26, 10:52, or 10:56.

In this same example, suppose Player C receives 10 as an hour card; and 2, 5, and 7 as minute cards. Thus, Player C may form the following time values: 10:25, 10:27, 10:52, and 10:57. As discussed above, the "10" 110 is worth 8 points, the "2" 202 is worth 5 points, the "5" 205 is worth 5 points, and the "7" 207 is worth 3 points. Thus, Player C may choose time value 10:25, which is worth 18 points (8+5+5); 10:27, which is worth 16 points (8+5+3); 10:52, which is worth 18 points (8+5+5); or 10:57, which is worth 16 points (8+5+3). Since each player receives a Didgi-Stick 400 for each 5 points scored, and Player C can form time values worth either 16 or 18 points, he would also receive 3 Didgi-Sticks 400, regardless of whether he formed 10:25, 10:27, 10:52, or 10:57.

In this same example, suppose Player D receives 1 as an hour card 101; 0 and 8 as minute cards, 200 and 208, respectively, and one Wild Card 330. Since "1" for one o'clock 101 is only worth 2 points, Player D may wish to use her Wild Card 330 as her hour card. If Player D declares that the Wild Card 330 is an "8" 108, she could form the combination 8:08, which is worth 20 points (7+6+7). If Player D declares that the Wild Card 330 is a "12" 112, she could form the combination 12:08, which is also worth 20 points (2+5+6+7). If Player D declares that the Wild Card 330 is a "10" 110, she could form the combination 10:08, which is worth 21 points (2+6+6+7). There are also many other combinations that Player D may form using the Wild Card 330, such as 3:08 (18 points), 4:08 (17 points), 5:08 (18 points), 6:08 (19 points), 7:08 (16 points), 9:08 (19 points), and 11:08 (17 points). However, Player D would likely pick 10:08, because it forms the highest number of points (21 points), or 12:08, because it forms the highest time value and is still worth 20 points, depending on whether the game is being played where the winner is the one who earns the most points or forms the highest time value.

Since, in this embodiment of the game, each player receives a Didgi-Stick 400 for each 5 points scored, Player D can form time values of either 8:08, 10:08, or 12:08, which are all worth at least 20 points to receive 4 Didgi-Sticks 400. On the other hand, if Player D formed time values of either 3:08, 4:08, 5:08, 6:08, 7:08, 9:08, and 11:08, which are all worth at least 15 points, but less than 20 points, she would only receive 3 Didgi-Sticks 400. Thus, at the end of the first round, Players A, B, and C would receive 3 Didgi-Sticks 400, and Player D would receive either 3 or 4 Didgi-Sticks 400 depending on the time value that she chose to form. Thus, there is some skill in recognizing time values with more points so that the player can earn more Didgi-Sticks 400.

In another embodiment of the game, each player would receive one Didgi-Stick 400 for each 6 points scored. Thus, if Player A is drawn the same cards as described in the above example, Player A would still form either a time value of 10:24, which is worth 17 points, or 10:27 is worth 16 points. In this case, Player A could use either combination to get at least 12 points for 2 Didgi-Sticks 400, but no time value combination would add up to at least 18 points for 3 Didgi-Sticks 400. Therefore, Player A would receive 2 Didgi-Sticks 400.

In this same embodiment, where 6 points are needed to earn a Didgi Stick, if Player B is drawn the same cards as described in the above example, Player B would still form either a time value of 10:25 that is worth 18 points, 10:26 that is worth 19 points, 10:52 that is worth 18 points, or 10:56 that is worth 19 points. In this case, Player B could use any of these combinations to get at least 18 points for 3 Didgi-Sticks 400. Therefore, Player B would receive 3 Didgi-Sticks 400.

In this same embodiment, if Player C is drawn the same cards as described in the above example, Player C would still form either a time value of 10:25 that is worth 18 points; 10:27 that is worth 16 points, 10:52 that is worth 18 points; or 10:57 that is worth 16 points. In this case, if Player C formed the time value of either 10:27 or 10:57, he would have 16 points, which would only allow him to obtain 2 Didgi-Sticks 400. However, if Player C recognized that he could also form either 10:25 or 10:52 with these same cards, he would receive 18 points. Thus, the number of Didgi-Sticks 400 that Player C will receive in this round is depended on which time value be forms. If he forms 10:25 or 10:52, he would receive 3 Didgi-Sticks 400. Therefore, there is some skill involved in recognizing the time values, which yield the highest number of points.

In this same example, suppose Player D is drawn the same cards as described in the above example. If Player D formed the combination of either 4:08 (17 points), 7:08 (16 points), or 11:08 (17 points) she would only receive 2 Didgi-Sticks 400 for forming at least 12 points, but less than 18 points. However, if Player D formed the combinations 3:08, 5:08, 6:08, 8:08, 9:08, 10:08, or 12:08, which are all worth at least 18 points, Player D would receive 3 Didgi-Sticks 400.

At the end of the first round of this alternative embodiment, where 6 points are needed for each Didgi-Sticks 400. Player A would receive 2 Didgi-Sticks 400, Player B would receive 3 Didgi-Sticks 400, Player C would receive either 2 or 3 Didgi-Sticks 400 depending on the time value he formed, and Player D would receive either 2 or 3 Didgi-Sticks 400 depending on the time value she formed. Thus, by varying the number of points that each Didgi-Stick 400 is valued at, the game could be more strategic in regards to which time value to form.

In another embodiment of the game, each player may receive one Didgi-Stick 400 for each 7 points scored. Thus, if Player A is drawn the same cards as described in the above example, Player A would still form either a time value of 10:24 (17 points) or 10:27 (16 points). In either case, Player A could use either combination to get at least 14 points for 2 Didgi-Sticks 400, but no time value combination would add up to 21 for 3 Didgi-Sticks 400. Therefore, Player A would receive 2 Didgi-Sticks 400.

In this same embodiment, if Player B is drawn the same cards as described in the above example, Player B would still form either a time value of 10:25 (18 points), 10:26 (19 points), 10:52 (18 points), or 10:56 (19 points). In this case, Player B could use any combination to get at least 14 points for 2 Didgi-Sticks 400, but no time value combination would add up to 21 for 3 Didgi-Sticks 400. Therefore, Player B would also receive 2 Didgi-Sticks 400.

In this same embodiment, if Player C is drawn the same cards as described in the above example, Player C would still form either a time value of 10:25 (18 points); 10:27 (16 points), 10:52 (18 points), or 10:57 (16 points). In this case, Player C could use any combination to get at least 14 points for 2 Didgi-Sticks 400, but no time value combination would add up to 21 for 3 Didgi-Sticks 400. Therefore, Player C would also receive 2 Didgi-Sticks 400.

In this same example, if Player D is drawn the same cards as described in the above example, suppose Player D formed the combination 3:08, 4:08, 5:08, 6:08, 7:08, 8:08, 9:08, or 12:08. Since these combinations are all worth at least 14 points, but less than 21 points, Player D would receive 2 Didgi-Sticks 400. However, if Player D formed the combination of 10:08 (21 points) she would receive 3 Didgi-Sticks 400.

Thus, at the end of the first round of this alternative embodiment, Player A, B, and C would all have received 2 Didgi-Sticks 400, but Player D would have received 3 Didgi-Sticks 400, if she used her Wild Card 330 to form 10:08. Otherwise, Player D would only receive 2 Didgi-Sticks 400 for forming any other combination. Thus, by varying the number of points required for each Didgi-Stick 400 the game could be more strategic in that only a skilled player would recognize the highest point value combination to obtain the most Didgi-Sticks 400.

In yet another embodiment, the game may be played where only the player with the highest time value receives his points, and the corresponding number of Didgi-Sticks 400. Alternatively, points may then be added from round to round until a player receives 150 points or any other number of points that are predetermined before the game begins. The other players would not receive and Didgi-Sticks 400.

For example, if Player A is drawn the same cards as described in the above examples, Player A could form either a time value of 10:24 worth 17 points or 10:27 worth 16 points. Player A may decide to place down the higher point value of 10:24 in hopes of having the highest time and receiving 17 points. However, by choosing 10:24 rather than 10:27, Player A is taking a small risk that another player may have 10:25 or 10:26 and be declared the winner based on his higher time value. For this example, we will assume that Player A chooses the time value of 10:24 in hopes of having the highest point value and earning 17 points.

In this same example, suppose Player B is drawn the same cards as described in the above examples, so that he may form the same time values of 10:25 (18 points), 10:26 (19 points), 10:52 (18 points), and 10:56 (19 points). Thus, Player B will likely choose 10:56, since it yields both the highest time and the greatest number of points.

In this same example, suppose Player C is drawn the same cards as described in the above examples, so that he may form the same time values of 10:25 (18 points), 10:27 (16 points), 10:52 (18 points), or 10:57 (16 points). Player C would likely recognize that the highest time is 10:57, but that it is only worth 16 points, while 10:52 is a lower time, but it is worth 18 points. Suppose Player C picks his second highest time value of 10:52, since it is his highest value of 18 points, rather than his highest time value of 10:57 with its slightly lower value of 16 points. Player C's time value of 10:52 would be higher than Player A's highest time value of 10:27. Thus, Player A would not receive any points. Player C's time value of 10:52 would also be higher than Player D's highest time value of 10:08. Thus, Player D would also not receive any points. However, Player C's time value of 10:52 would be lower than Player B's time value of 10:56. Thus, Player C would also not receive any points. Therefore, Player B would be the winner with the highest time value of 10:56, which is equivalent to 19 points. Therefore, if each Didgi-Stick 400 is valued at 4 points, Player B would receive 4 Didgi-Sticks 400 for having at least 16 points. In this same example, if each Didgi-Stick 400 is valued at 5 points, Player B would receive 3 Didgi-Sticks 400 for having at least 15 points. If each Didgi-Stick 400 is valued at 6 points, Player B would still receive 3 Didgi-Sticks 400 for having at least 18 points. If each Didgi-Stick 400 is valued at 7 points, Player B would receive 2 Didgi-Sticks 400 for having at least 14 points.

In a variation of the above example, suppose Player C chooses to put down his highest time value of 10:57, which is only worth 16 points, even though he has a time value of 10:52 that is worth 18 points. In this case, not only would Player C's time value still be higher than both Player A's and Player D's, but it would also be one minute higher than Player B's time value of 10:56. Thus, Player C would be the winner with the highest time value of 10:57. Therefore, if each Didgi-Stick 400 is valued at 4 points, Player C would receive 4 Didgi-Sticks 400 for having at least 16 points. If each Didgi-Stick 400 is valued at 5 points, Player C would receive 3 Didgi-Sticks 400 for having at least 15 points. If each Didgi-Stick 400 is valued at 6 points, Player C would still only receive only 2 Didgi-Sticks 400 for having at least 12 points. If each Didgi-Stick 400 is valued at 7 points, Player C would receive 2 Didgi-Sticks 400 for having at least 14 points. Thus, under this example, Player C would win or lose depending on the time value he chose, assuming Player D chose the lower time value of 10:08.

In yet another embodiment of the game, more than one player may win Didgi-Sticks 400, where the winners may be determined by the player with the highest time value and the player with highest number of points. Thus, if a player had both the highest time value and the highest number of points, he may obtain two Didgi-Sticks 400 in that round. If there is a tie between players with the highest time value or highest number of points, the players could agree in advance or in accordance with the rules that the game is being played under, that both or neither would receive a Didgi-Stick. In another alternative embodiment, in the event of a tie, the next round could be just played with just the players who tied, where the winner receives twice the number of Didgi-Sticks 400. If there is another tie in the second round, the players could either split the Didgi-Sticks 400 or engage in additional rounds between them, until a winner is determined.

For example, suppose that the rules are set where the players receive one Didgi-Stick 400 for the highest time value, one Didgi Stick 400 for the highest point value, and in the event of a tie, both tying players receive a Didgi-Stick 400. Thus, using the cards drawn to the players in the above examples, suppose Player A chooses the time value of 10:24 in hopes of having the highest point value and earning 17 points. Player B would likely pick his highest time value of 10:56, which is also his highest point value of 19. Player C would decide between using his highest time value of 10:57 that is worth 16 points, or his highest point value of 18 points that is equivalent to a time value of 10:52. Player D would likely form 10:08 for 21 points.

If Player A forms 10:24 for 17 points, Player B forms 10:56 for 19 points, Player C forms 10:57 for 16 points, and Player D forms 10:08 for 21 points, then Player C would have the highest time value of 10:57, and Player D would have the highest points of 21. Thus, Players C and D would both receive one Didgi-Stick 400, and Players A and B would receive none.

On the other hand, suppose Player A still chooses the time value of 10:24 in hopes of having the highest point value and earning 17 points. Player B still picks his time value of 10:56 (19 points), but Player C picks his highest point value of 10:52 (18 points), and Player D forms 10:08 (21 points). In this case, Player D would still receive one Didgi-Stick 400 for forming 10:08, which is the highest point value of 21 points, but Player B would receive one Didgi-Stick 400 for the highest time value of 10:56. Thus, under this scenario, Player B and D would both receive one Didgi-Stick 400, and Players A and C would receive none.

In at least one embodiment, each player would place each of the Didgi-Sticks 400 he won in a specially designed open storage container 410 that is an elongated hexagon. When this open storage container 410 is filled, it will undergo a transformation of appearing to be a large digital segment like the horizontal center section of a digital number with one Didgi Stick raised in the center to indicate the winner. For example, suppose the container 410 was designed to hold a maximum of 29 Didgi-Sticks 400 as shown in FIG. 25. The container 410 would have an obstruction, such as an inverted cone 420 protruding upwards inside the container 410 in the center of its bottom 415 as shown in FIGS. 22 and 25. This inverted cone 420 would divert the first 28 Didgi-Sticks 400 away from the center causing them to rest around the center of the container 410. Only when a player obtained his $29^{th}$ Didgi-Stick, could this be placed in the center of the container 410 and in an elevated position as it is raised by the inverted cone 420 and supported by the surrounding 28 Didgi-Sticks 400. This elevated stick in the center of the container 410 would be a visual aid to other players that the container 410 is full and the player has obtained 29 sticks, so that a winner could be quickly determined without counting the Didgi-Sticks 400 that were obtained by a player. This transformation is even more beneficial if the elongated hexagonal containers 410 are designed to hold a larger number of Didgi-Sticks 400, because it will save even more time, because less sticks would need to be counted.

In yet another embodiment, an Adult Version of the game may be played where the object is to collect the most Didgi-Sticks 400 by making a run of three sequential time values in a predetermined number of rounds to be played. A round is ended when one player has completed three sequential time values. Before play begins, players determine how many rounds will be played, such as three to five rounds. Then the Bonus Cards 310 are removed from the deck and the Didgi-Thief cards 340 are added. The deck is shuffled and placed with the face of the cards down, on the table. Each player must have a complete three-card time value to begin play. The first player draws four cards from the deck. If that player can form a sequential time value, she places the cards, face up on the table. At that time, the player must declare which sequential time value she is going to play and it cannot be changed during the round. The sequential time value can be formed in one of two ways, as follows: Using the hour as the sequential number, the minute numbers must remain the same in the sequence, i.e., Play number one=1:20; Play number two must=2:20; Play number three must=3:20. Using the minute numbers as the sequential number, the hour number must remain the same in the sequence, i.e., Play number one=6:23; Play number two must=6:24; and Play number three must=6:25. Once a player has opened with a time value she may use as many of the four cards drawn in succeeding turns as needed to begin forming the two remaining time values. For example, in Turn one, a player draws 6:23. In Turn two, that player draws 7-0-5-9. The "5" may be placed on the table to begin forming the time value 6:25 and discard 7-0-9. In Turn three, the player draws four cards and has drawn a 2-6-4 and a 1. The player may strategize in keeping the 2-6 and 4 in hand to protect against a Didgi-Thief steal by another player and just discard the 1.

In yet another embodiment, if, in the first draw, the player cannot form a time value she must discard all four cards and draw four new cards at her upcoming turns until a full sequential time value can be played. Once the time value is played, the player can elect to discard the remaining card or hold it until her next turn. At that time the player will draw from the deck the appropriate number of cards to replace the discards or cards placed on the table. She may then: (1) lay down or hold as many of the cards in hand needed for the remaining two sequential time values, and/or (2) discard any cards of no use to the time value.

A player may only keep 4 cards in her hand at any given time. If a player draws a Lose-a-Turn Card 320 all the cards drawn at that time must be discarded and play continues to the next player. Wild Cards 330 are playable for any time value at any time. Didgi-Thief cards 340 may not be used until a player has the first of the three time values showing on the table.

Play continues until a player completes making three sequential time values. If a player receives the 10 Bonus points card 330, he adds them to the total points used in the Didgi-Stick 400 time values for the completed hand. For each 15 points scored, the player receives one Didgi-Stick 400 to be placed in her container 410. All other players receive Didgi-Sticks 400 for cards forming one or two complete time values in that round and collects the appropriate number of Didgi-Sticks 400 to put in the container 410. Play continues for as many rounds that were predetermined at the beginning of the game. The unused cards in the discard pile may be reshuffled as often as necessary until the end of the game. The player with the most Didgi-Sticks 400 in her container 410 wins the game. Alternatively, play may end when the first player obtains 29 Didgi-Sticks 400, which is signified by the container 410 being transformed into a large digital center segment of a digital number with a center Digital Stick being in an elevated position.

An example of one embodiment, where 4 players are simultaneously drawn 4 cards each is described as follows. In this example, the plurality of hour cards is a series of generally rectangular extrusions, which may be used to represent the hour values when players create time values to score points. In at least one embodiment the cards are printed on substantially flat surfaces and shaped as elongated hexagons so that they resemble the center horizontal segment of a digital number. The plurality of hour cards comprises a plurality of lines and a guide. The plurality of lines is a series of vertical and horizontal lines printed onto the plurality of hour cards and arranged as the seven segment display common in digital clocks and timers. The numbers represented by the plurality of lines span integral values from 1 to 12. The guide may be a horizontal line printed adjacent to the plurality of lines. The guide helps a user distinguish between card values that may otherwise be confusing to read, particularly between six and nine, and between two and five.

The plurality of minute cards is a series of generally rectangular extrusions which, in at least one embodiment of playing the present game, are used to represent the minute values when players create time values to score points. The plurality of minute cards comprises a plurality of lines and a guide. The plurality of lines is a series of vertical and horizontal lines printed onto the plurality of minute cards and arranged as the seven segment display common in digital clocks and timers. The numbers represented by the plurality of lines span integral values from 0 to 9. The guide may be a horizontal line printed adjacent to the plurality of lines. The guide helps a user distinguish between card values that may otherwise be confusing to read, particularly between six and nine, and between two and five.

The plurality of special cards is a series of generally rectangular extrusions that allow for printing of non-number values. The plurality of special cards comprises a plurality of Wild Cards 330, a plurality of Lose-a-Turn 320 cards, a plurality of Bonus Card 310, and a plurality of Didgi-Thief cards 340. Each special card of the plurality of special cards may be used to vary gameplay and add a dimension of strategy to the method of playing the present card game. In at least one embodiment, usage of the plurality of Wild Cards 330, a Wild Card 330 of the plurality of Wild Cards 330 can be used to take the place of a minute card or hour card as needed by the player. In at least one embodiment, a Lose-a-Turn Card 320 may be used by the player to skip the turn of the next player during gameplay. In at least one other embodiment, a Bonus Card 310 may be used to add ten points to the overall score of the player to activate the Bonus Card 310. In yet at least one other embodiment, a Didgi-Thief card may be used by a player to steal a previously drawn card from another player, and added to the hand of the player who played the Didgi-Thief card.

The scorecard 300 is a sheet of paper that allows participants to track scores during gameplay. The scorecard 300 comprises a plurality of markings and a grid pattern, as seen in FIG. 15. The grid pattern is a printed grid shape on the optional scorecard 300 that divides the optional scorecard 300 into sections. The plurality of markings is a series of indicators in conjunction with the grid pattern that shows at least one embodiment, locations for player names, round names, and score totals.

In an exemplary method of playing the Didgi-Sticks 400 Card game, players gather around a table or generally flat surface. The method comprises at least a setup step and a gameplay step. During setup, the players remove the plurality of Bonus Cards 310 from the plurality of special cards. Players then shuffle the plurality of hour cards, the plurality of minute cards, and the remaining plurality of special cards together to form the deck. The players then place the deck onto the table.

Gameplay begins when the deck is set on the table. The gameplay phase comprises choosing a starting player, drawing cards, placing a time value, declaring the sequential varying number increasing the time value, adding points to the score of the player to place the last sequential time value, and completion. In at least one embodiment, playing order is determined by each player picking a card from the deck, and the highest card number determining the starting player. In alternative embodiments, the first player to pick cards from the deck may be determined by a variety of means, including coin tosses, consensus, and a variety of other means involving the deck of the present invention, and the exemplary embodiment is not meant to be limiting.

After the first player is determined, the first player draws a plurality of cards from the deck. In at least one embodiment, there are four cards drawn from the deck during drawing. The first player attempts to combine the drawn cards to create a time value. A time value is a combination of one hour card and two minute cards. In an alternative embodiment, the time values must be real time values, so the minute cards must be played so that they range from 0:00 to 0:59. If the first player has a valid time value, that player places the relevant three cards face up on the table, and places the fourth card face down on the table or surface. The face down card forms the discard pile. Once the player places a time value on the table or surface, the player declares a value to increase, either the plurality of hour cards or the plurality of minute cards. If the first player cannot form a time value with the cards drawn, those cards are discarded, and the next player draws four cards.

This process continues until a player successfully completes a time value and declares either the plurality of hour cards or the plurality of minute cards. Once the declaration has been made, the score earned by the player who played the time value is tallied. To tally the score, the number of lines of the plurality of lines of the plurality of hour cards and the plurality of lines of the plurality of minute cards is counted and subsequently recorded in the appropriate slot on the optional scorecard 300. Play then continues clockwise around the table or surface.

The next player draws a plurality of cards, such as four cards, and attempts to play the next consecutive value in the time value, either a minute card or an hour card, as declared by the first player. If the player cannot complete the next time value, the player discards a plurality of cards from the player's hand, plays a special card, or places a minute card or hour card onto the table or surface face up for later use. If the player can form the next consecutive time value, the number of lines of the plurality of lines of the plurality of hour cards and the plurality of lines of the plurality of minute cards is counted and subsequently recorded in the appropriate slot on the optional scorecard 300. This process continues until a plurality of consecutive time values, preferably three time values, have been formed. At that time, the time values are discarded, the last player to play a time value receives and records an extra ten points, and the winning player draws a plurality of cards from the deck to create a new time value. Play thus continues until a score of 150 points has been reached. Then the completion step begins. The winner is the player to first reach 150 points. The deck is then divided into the plurality of minute cards, the plurality of hour cards, and the plurality of special cards. The present invention is then ready for subsequent use.

Although the invention has been explained in relation to its at least one embodiment, embodiment, it is to be understood that many other possible modifications and variations can be made without departing from the spirit and scope of the invention as hereinafter claimed.

All of these embodiments and the invention disclosed herein are intended to be within the scope herein disclosed. These and other embodiments of the invention will become readily apparent to those skilled in the art from the detailed description of the embodiments having reference to the attached figures, the embodiments not being limited to any particular embodiments disclosed. Also, the invention disclosed herein suitably may be practiced in the absence of any element which is not specifically disclosed herein.

What is claimed is:

1. A device that transforms to signify the winner of a game, comprising:

a plurality of elongated sticks having a lower end and an upper end and all of said plurality of elongated sticks having the same length;

an open storage container having a bottom wall and at least one side wall, which is sized to hold an exact number of said elongated sticks when placed in the open storage container in an upright vertical orientation;

an obstruction, having a lower end and an upper end, said construction mounted on the bottom wall in said open storage container, said obstruction is capable of both diverting all but a last of said elongated sticks placed in the upright vertical orientation in said open storage container into a space surrounding said obstruction, and said obstruction supporting the last of said elongated sticks placed in the upright vertical orientation in said open storage container at a higher elevation than all of the other of said elongated sticks placed in said open storage container, wherein the player who first transforms his said open container into a solid shape by filling it with said elongated sticks where the last of said elongated sticks placed in said open container remains at the higher elevation than all of the other elongated sticks, is the winner of a game.

2. The device of claim 1 wherein said open storage container is selected from the group consisting of a cylinder, oval, ellipsoid, triangle, square, pentagon, hexagon, octagon, and any other multisided shape.

3. The device of claim 1 wherein said elongated sticks have a cross-sectional area that is selected from the group consisting of a cylinder, oval, ellipsoid, triangle, square, pentagon, hexagon, octagon, and polygon.

4. The device of claim 1 wherein at least one end of said elongated sticks has a shape that is selected from the group consisting of wedge-shape, pyramid-shape, conical-shape, and semispherical shape, wherein the end of said elongated sticks prevent all but the last said elongated stick placed in said open storage container from resting on the top of said obstruction.

5. The device of claim 1 wherein said obstruction has at least an upper end that is selected from the group consisting of wedge-shape, pyramid-shape, conical-shape, and semi-spherical shape to prevent all but the last of said elongated sticks that is placed in said open container from resting on the top of said obstruction.

6. The device of claim 1 wherein said open container that is filled with any number of said elongated sticks provides a visual means to determine the player who is leading in said game without the need to count the number of said elongated sticks collected by any player.

7. The device of claim 1 wherein said open container being transformed into a solid shape by filling it with said elongated sticks where the last of said elongated sticks placed in said open container remains at a higher elevation than all of the other of said elongated sticks providing a visual means to determine the winner of said game without the need to count the number of said elongated sticks collected by any player.

8. The device of claim 1 wherein said open storage container is sized to hold the exact number of said elongated sticks required to win said game.

9. The device of claim 1 wherein said open storage container is sized to hold exactly 29 elongated sticks.

10. The device of claim 1 wherein said open container is in the shape of an elongated hexagon so that when it is filled with said elongated sticks it is transformed into a solid shape resembling the center horizontal segment of a digital number to provide a visual means to determine the winner of said game without the need to count the number of said elongated sticks collected by any player.

* * * * *